US011661295B2

(12) United States Patent
Endo et al.

(10) Patent No.: US 11,661,295 B2
(45) Date of Patent: May 30, 2023

(54) SUPPORTING FRAME OF SHEET FEEDING DEVICE AND SHEET FEEDING DEVICE INCLUDING THE SUPPORTING FRAME

(71) Applicant: CANON KABUSHIKI KAISHA, Tokyo (JP)

(72) Inventors: Michiaki Endo, Chiba (JP); Kiyoshi Watanabe, Chiba (JP); Kazuhisa Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 17/180,204

(22) Filed: Feb. 19, 2021

(65) Prior Publication Data

US 2021/0269267 A1 Sep. 2, 2021

(30) Foreign Application Priority Data

Feb. 28, 2020 (JP) ..... JP2020-033881
Nov. 25, 2020 (JP) ..... JP2020-195549

(51) Int. Cl.
*G03G 21/00* (2006.01)
*B65H 5/06* (2006.01)
*G03G 21/16* (2006.01)

(52) U.S. Cl.
CPC ..... *B65H 5/062* (2013.01); *G03G 21/1619* (2013.01); *G03G 21/1647* (2013.01); *B65H 2402/35* (2013.01)

(58) Field of Classification Search
CPC ..... G03G 21/1647; G03G 21/1619; G03G 2221/1678; B65H 2402/40; B65H 2402/35; B65H 2402/30; B65H 2402/44; B65H 5/062; B41J 29/02
See application file for complete search history.

(56) References Cited

U.S. PATENT DOCUMENTS

| | | | |
|---|---|---|---|
| 9,841,730 B2 | 12/2017 | Yamaguchi et al. ... | B01D 46/10 |
| 10,031,468 B2 | 7/2018 | Endo et al. ..... | G03G 21/1619 |
| 10,473,140 B2 | 11/2019 | Kitajima et al. ..... | F16B 31/043 |

FOREIGN PATENT DOCUMENTS

JP 2006-208597 8/2006

*Primary Examiner* — Luis A Gonzalez
(74) *Attorney, Agent, or Firm* — Venable LLP

(57) ABSTRACT

A supporting frame of a sheet feeding device includes a bottom plate, a first side plate fixed to the bottom plate, and a second side plate fixed to the bottom plate. The first side plate includes a supporting portion, a first bent and erected portion, and a second bent and erected portion. The supporting portion includes a swing center portion having a swing center of the first side plate when the first side plate is positionally adjusted relative to the second side plate. In a direction in which a bending edge line formed between the supporting portion and the first bent and erected portion extends, the swing center portion projects downward than a lower end portion of the first bent and erected portion and a lower end portion of the second bent and erected portion are and contacts the bottom plate.

14 Claims, 13 Drawing Sheets

SUPPORTING FRAME OF SHEET FEEDING DEVICE AND SHEET FEEDING DEVICE INCLUDING THE SUPPORTING FRAME

FIELD OF THE INVENTION AND RELATED ART

The present invention relates to a supporting frame of a sheet feeding device for supporting an inner unit of a sheet feeding device.

Inside an image forming apparatus such as a copying machine or a printer and inside a sheet processing device, respecting unit including an image forming portion for forming an image on a sheet (recording material), such as a photosensitive drum or a developing device, and a feeding roller for feeding the sheet and the like are incorporated.

Further, each of the units incorporated in these apparatuses (devices) is supported by a supporting frame constituted by a metal plate or the like in general. Specifically, by a pair of side plates provided opposed to each other, one end and the other end of the incorporated unit are supported, respectively.

Accordingly, in the case where a relative position between the pair of side plates is deviated, a relative position between the one end and the other end of the incorporated inner unit is deviated, so that positional accuracy of the unit deterioration. For example, in the case where the incorporated unit is a feeding unit including a feeding roller pair, parallelism between rotation shafts of the respective rollers of the feeding roller pair is deviated, so that there was a liability that the sheet fed by the feeding roller pair is moved obliquely.

In order to solve this problem, Japanese Laid-Open Patent Application (JP-A) 2006-208597 discloses a constitution in which a pair of side plates is fixed to a base member in a state in which the base member is sandwiched between the pair of side plates.

However, in the constitution disclosed in JP-A 2006-208597, a relative position between the pair of side plates depends on parallelism of the base member. That is, in the case inclination such as warpage or distortion occurs on the base member, each of the pair of side plates is inclined or falls or the like, so that there was a liability that the relative position deviates. By this, there was a liability that positional accuracy of a unit supported by the pair of side plates becomes poor.

SUMMARY OF THE INVENTION

A principal object of the present invention is to provide a sheet feeding device supporting frame capable of improving accuracy of a relative position between a pair of side plates.

According to an aspect of the present invention, there is provided a supporting frame of a sheet feeding device for supporting a feeding unit including a feeding roller pair capable of nipping and feeding a sheet, comprising: a bottom plate; a first side plate fixed to the bottom plate and supporting one end side of the feeding unit with respect to a rotational axis direction of the feeding roller pair; and a second side plate fixed to the bottom plate with a predetermined interval from the first side plate and supporting the other end side of the feeding unit with respect to the rotational axis direction of the feeding roller pair, wherein the first side plate includes a supporting portion supporting the one end side of the feeding unit, a first bent and erected portion bent and erected substantially perpendicular to the supporting portion, and a second bent and erected portion provided on a side opposite from the first bent and erected portion with respect to a sheet feeding direction of the feeding unit and bent and erected substantially perpendicular to the supporting portion, wherein the supporting portion includes a swing center portion having a swing center of the first side plate when the first side plate is positionally adjusted relative to the second side plate, and wherein in a direction in which a bending edge line formed between the supporting portion and the first bent and erected portion extends, the swing center portion projects downward than a lower end portion of the first bent and erected portion and a lower end portion of the second bent and erected portion are and contacts the bottom plate.

Further features of the present invention will become apparent from the following description of exemplary embodiments with reference to the attached drawings.

Figure 3:
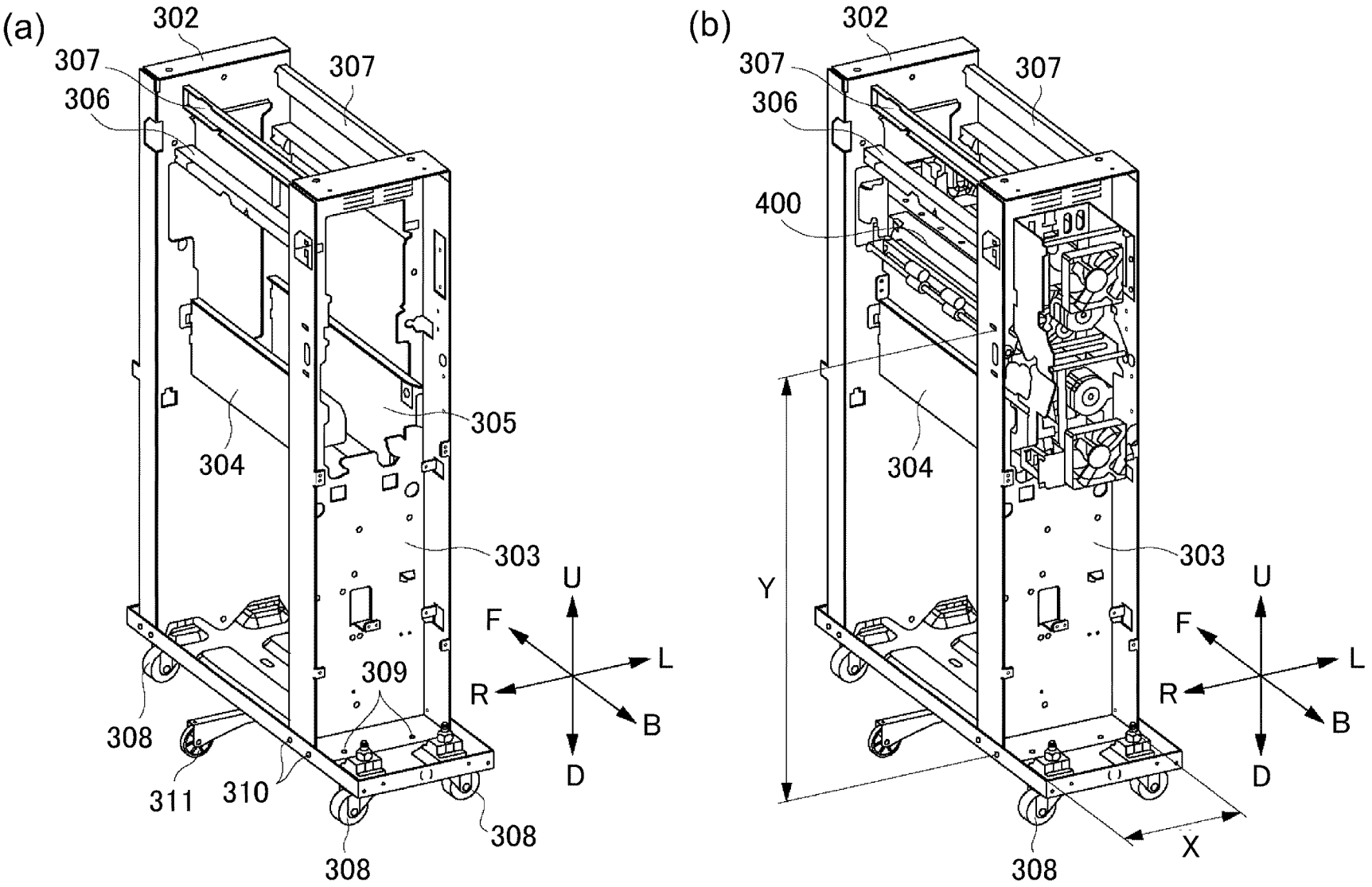

Parts (a) and (b) of FIG. 3 are perspective views of a supporting frame for the inspecting device.

Figure 4:
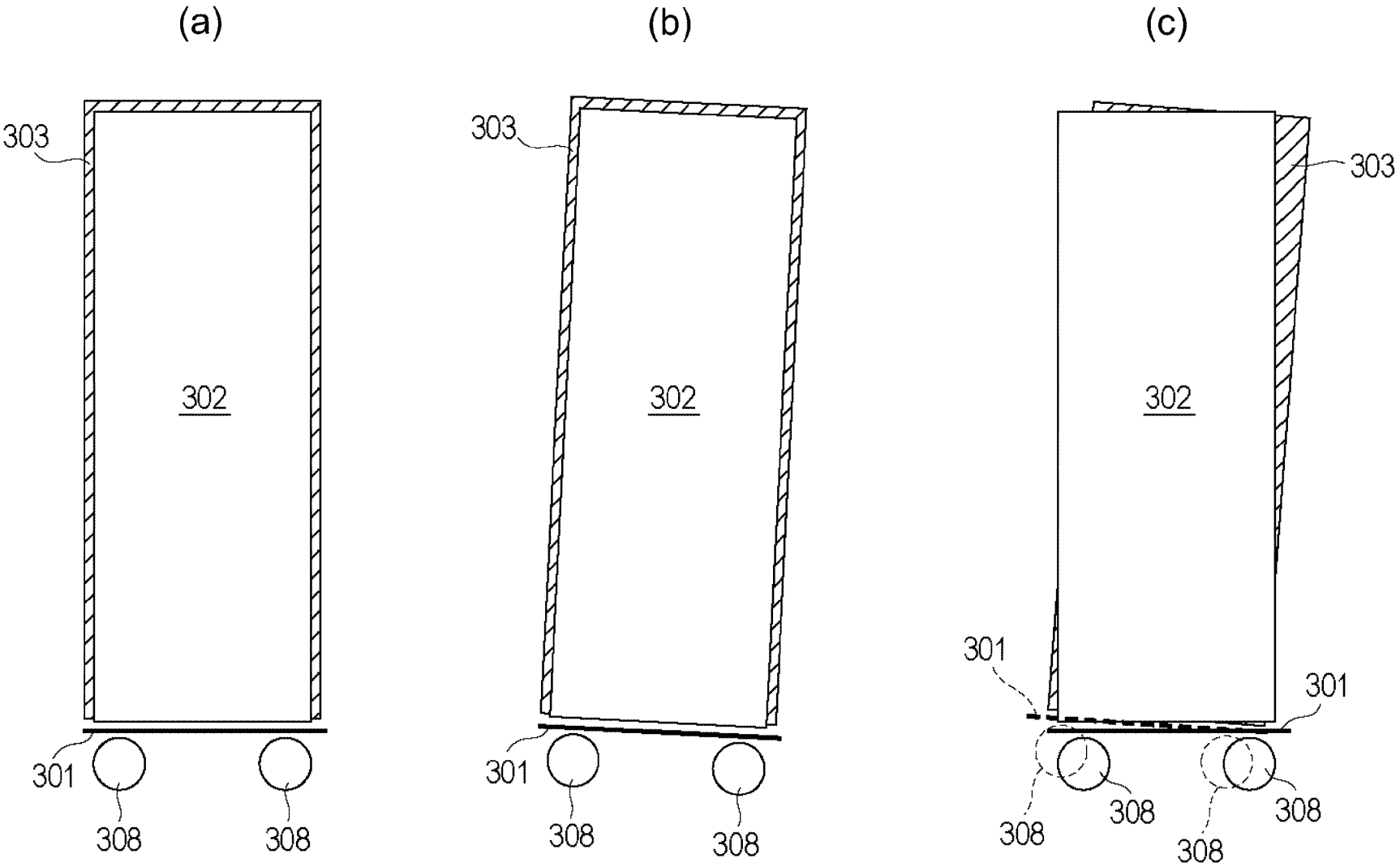

Parts (a), (b) and (c) of FIG. 4 are schematic views for illustrating inclination of front and rear side plates.

Figure 5:
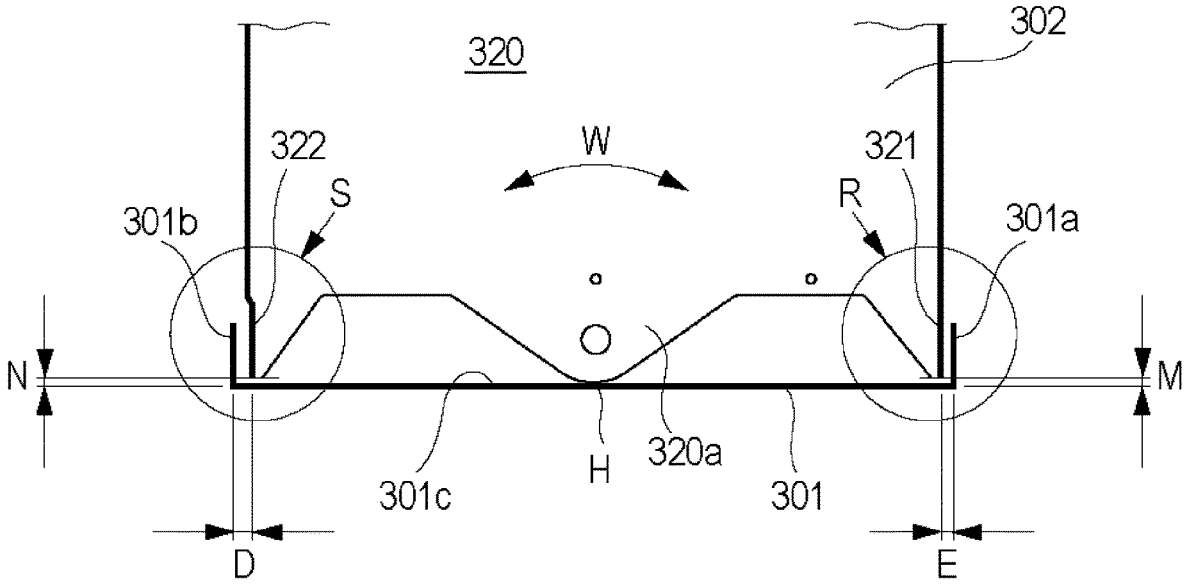

FIG. 5 is an illustration of a bottom plate contact portion of a front-side plate.

Figure 6:
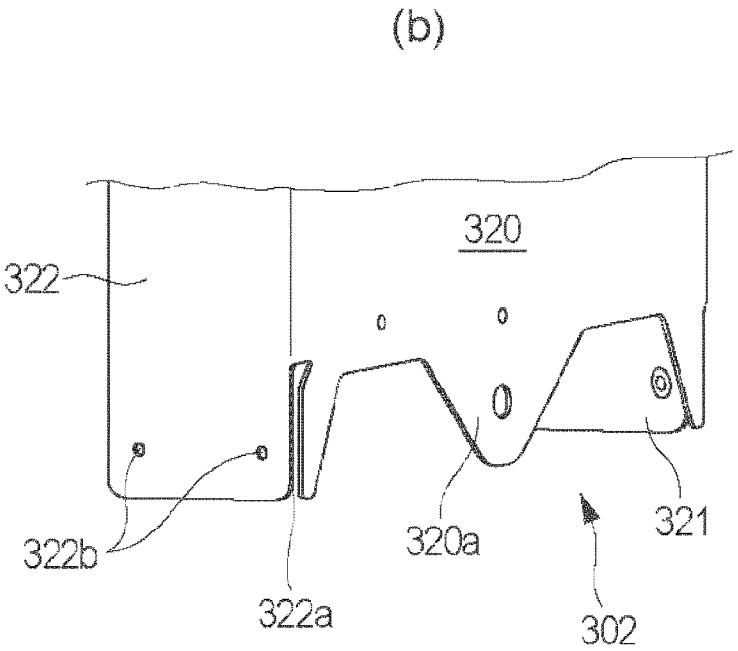
Figure 6:
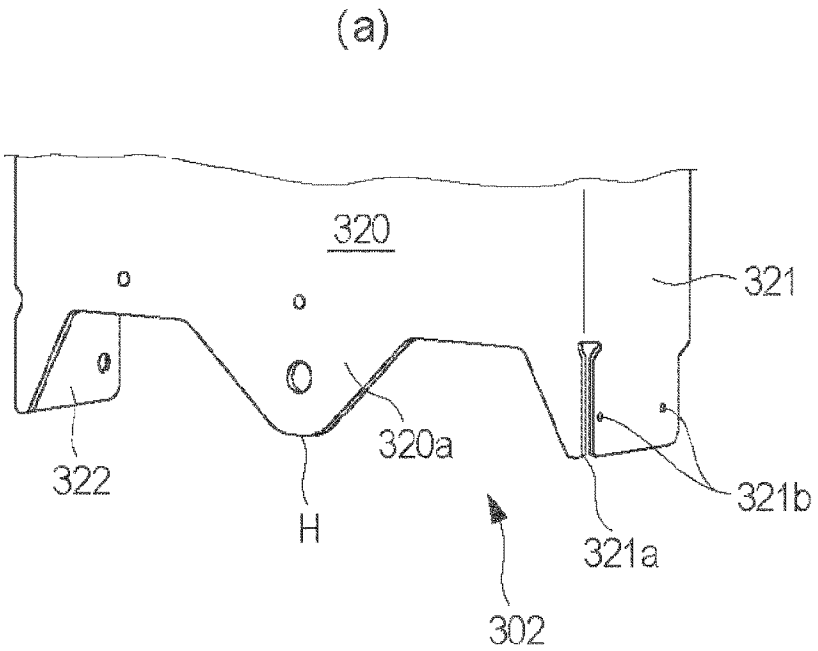

Parts (a) and (b) of FIG. 6 are enlarged views of the front-side plate.

Figure 7:
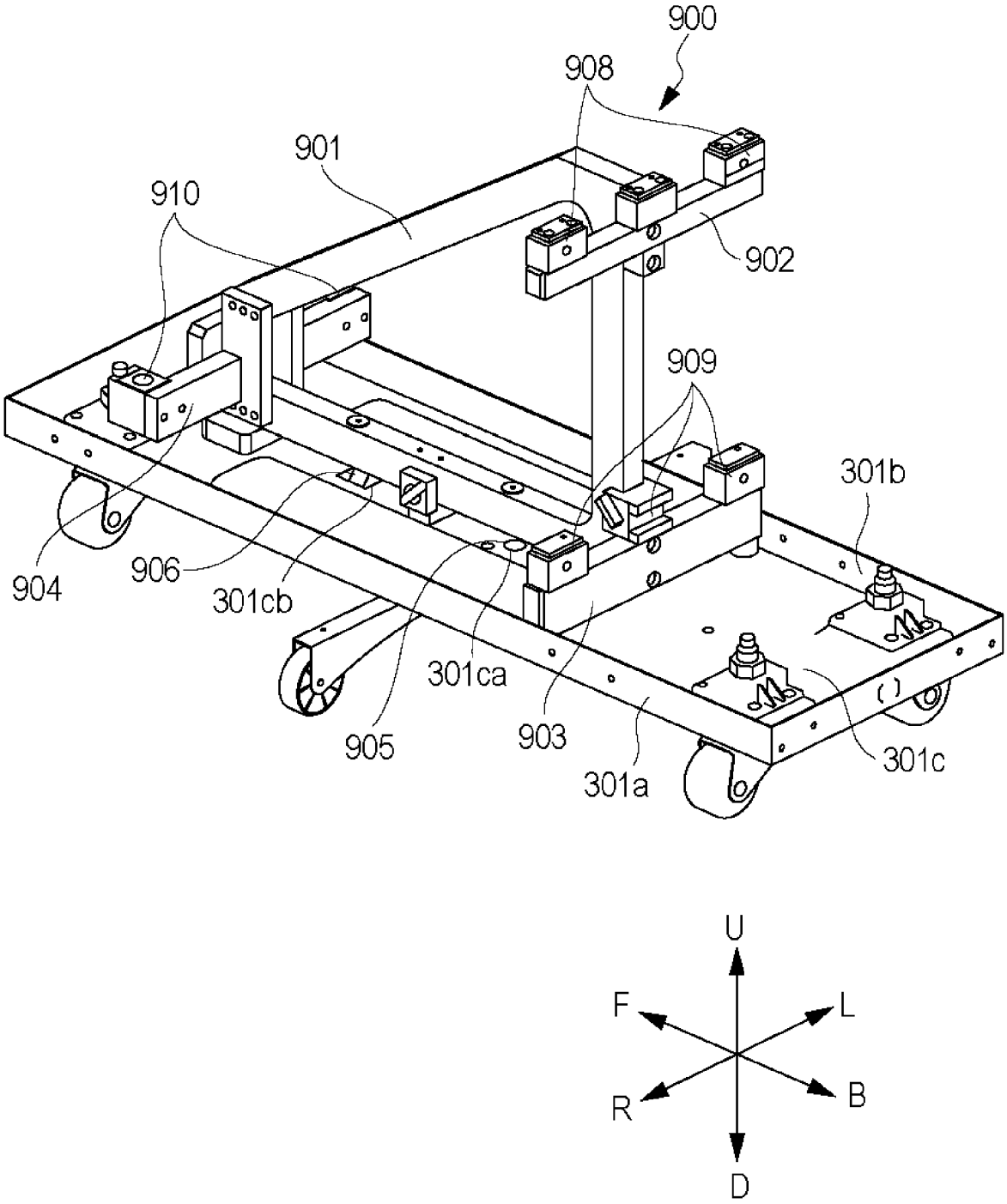

FIG. 7 is a perspective view for illustrating assembling of the supporting frame when a right-angled jig is mounted.

Figure 8:
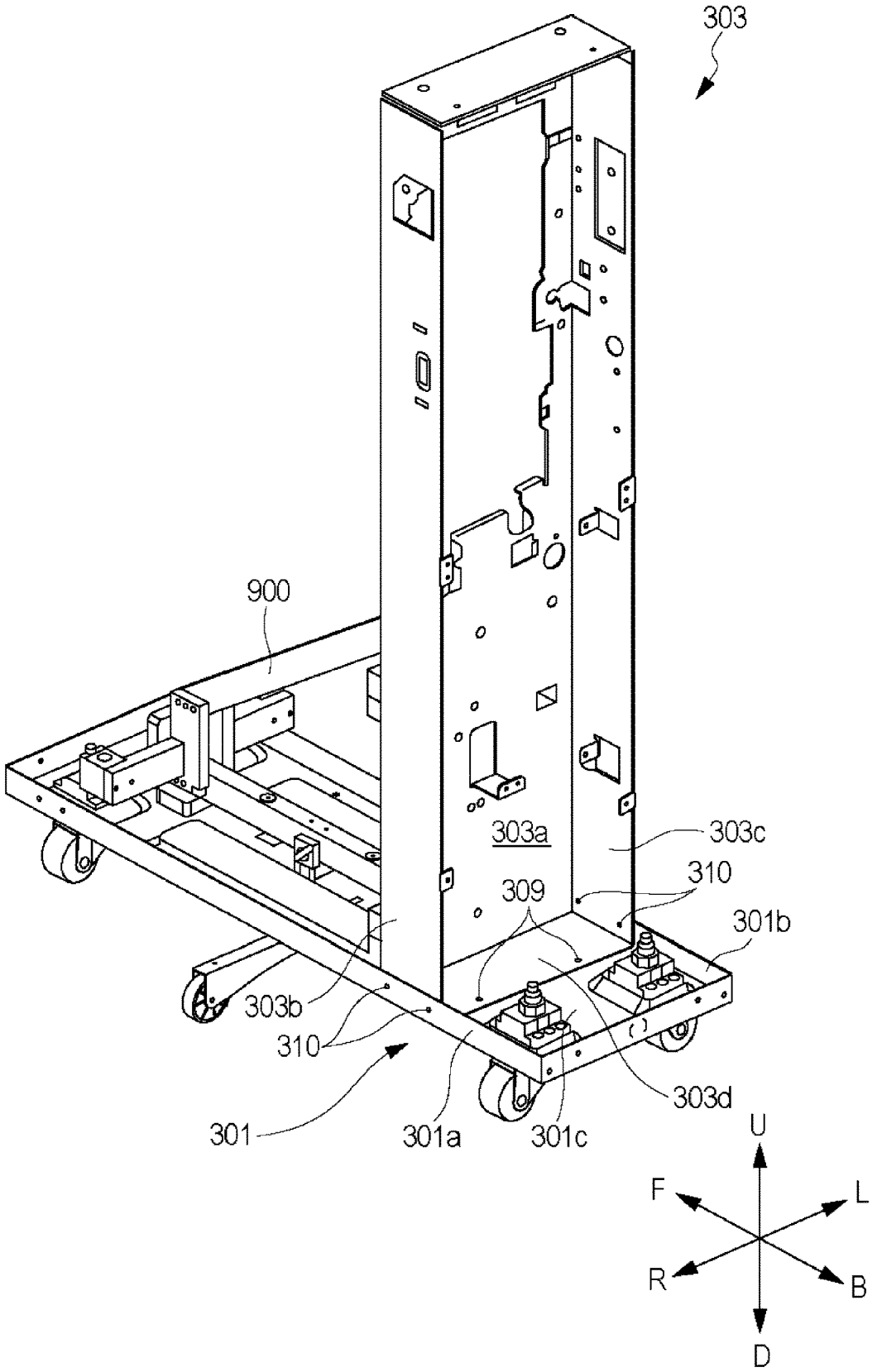

FIG. 8 is a perspective view for illustrating the assembling of the supporting frame when the rear side plate is mounted.

Figure 9:
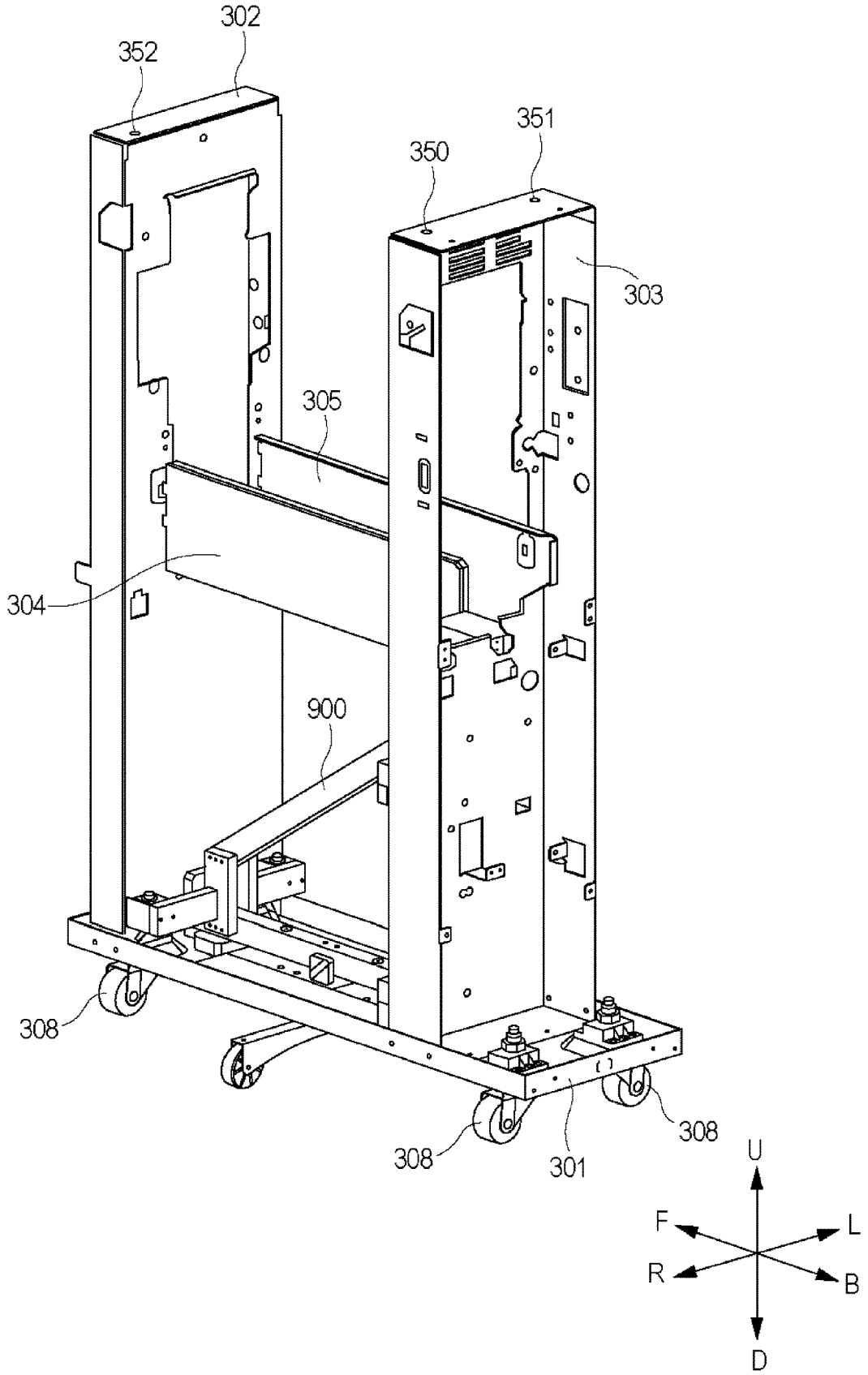

FIG. 9 is a perspective view for illustrating the assembling of the supporting frame when the front-side plate is mounted.

Figure 10:
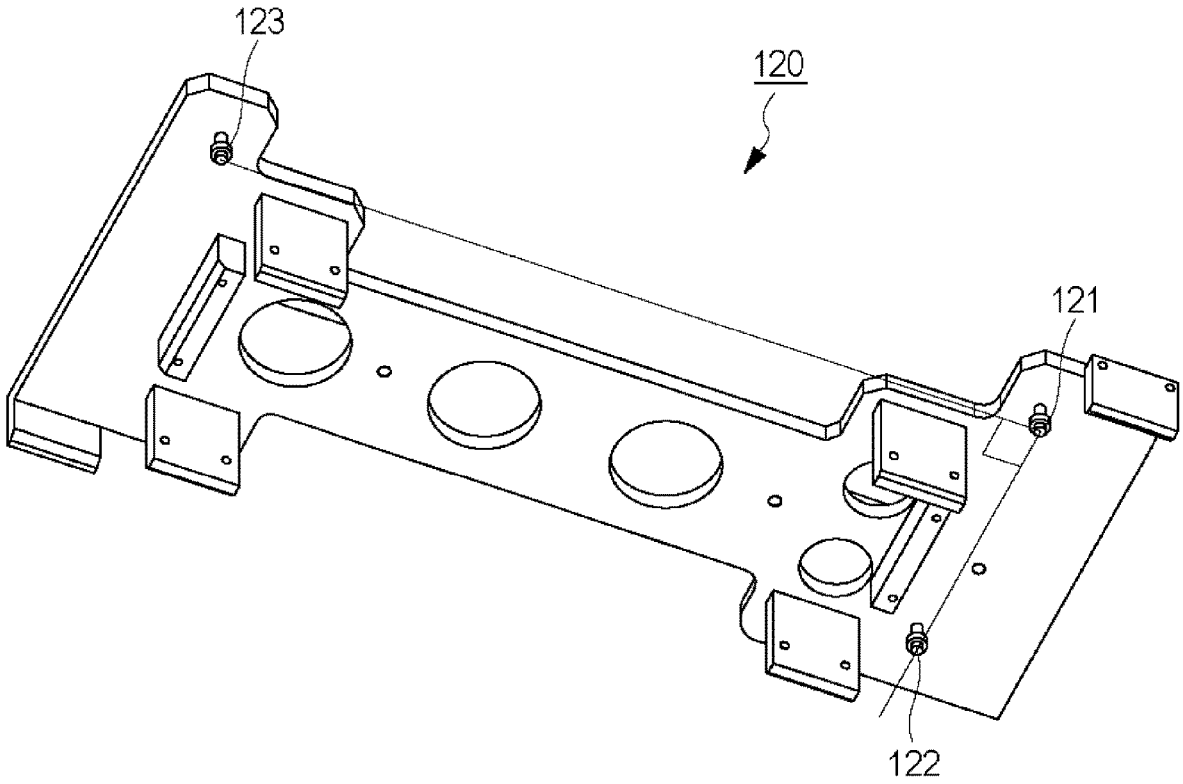

FIG. 10 is a perspective view of a front-side plate positioning jig.

Figure 11:
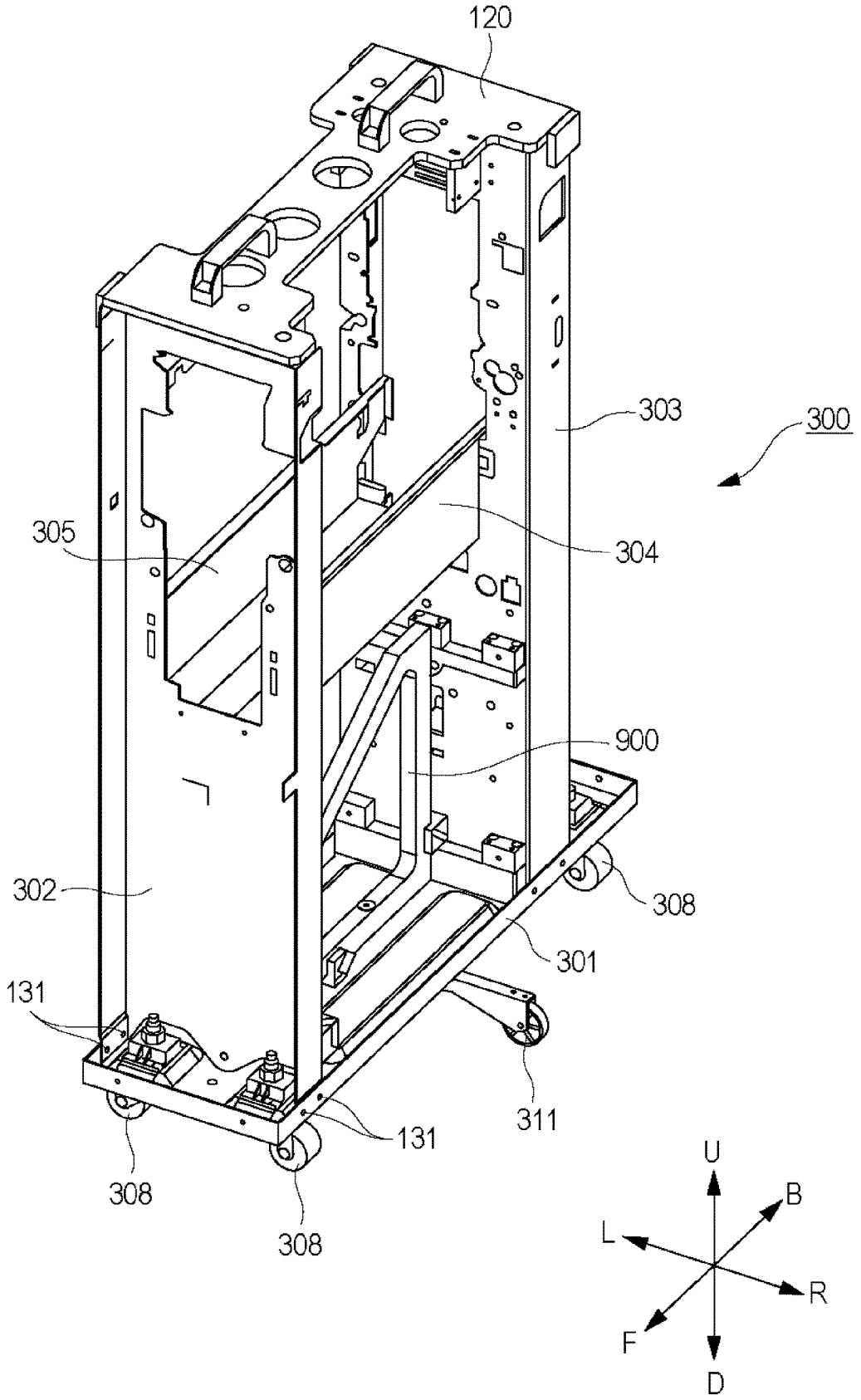

FIG. 11 is a perspective view for illustrating the assembling of the side plate when the front-side plate positioning jig is mounted.

Figure 12:
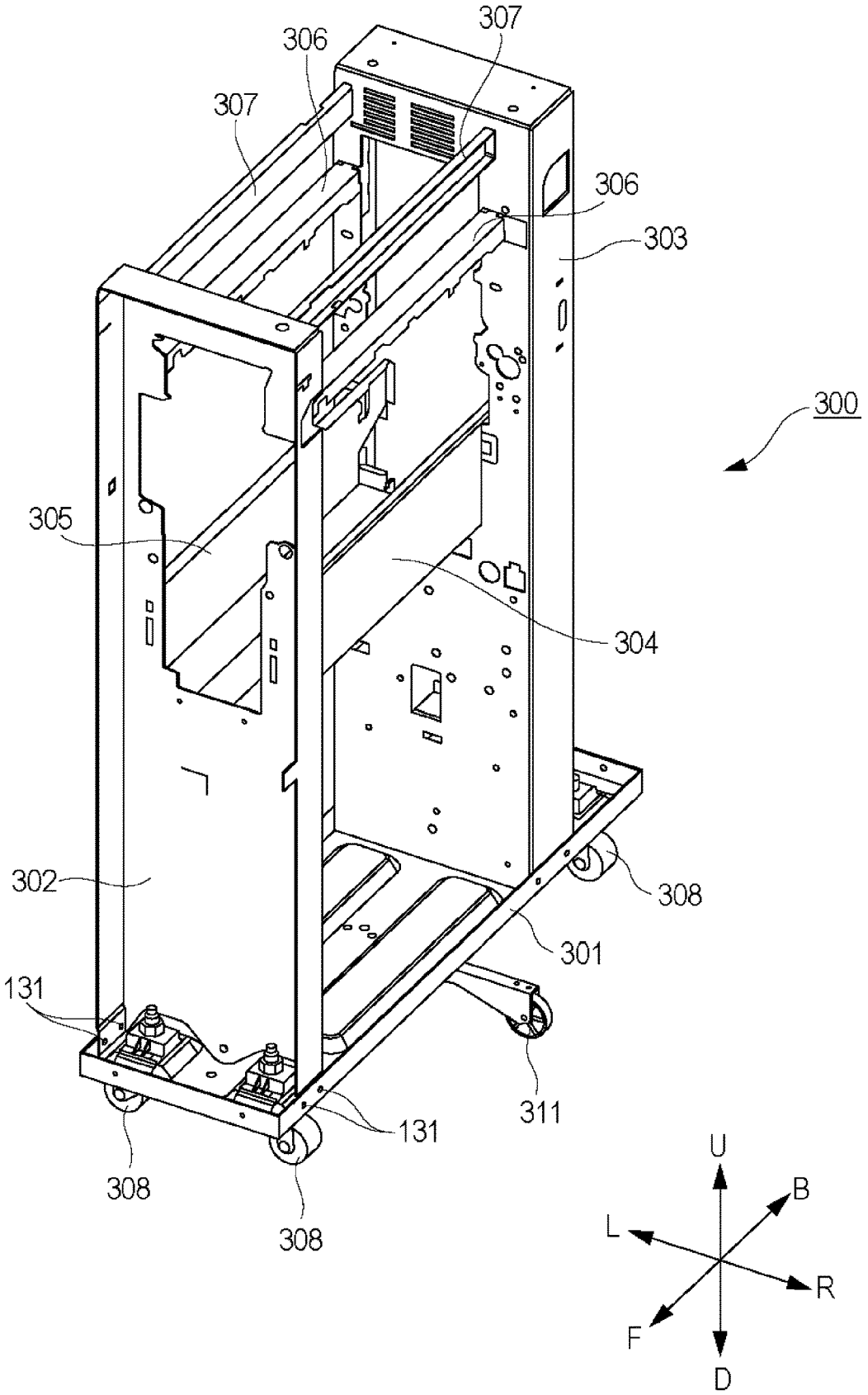

FIG. 12 is a perspective view of the supporting frame after the assembling.

Figure 13:
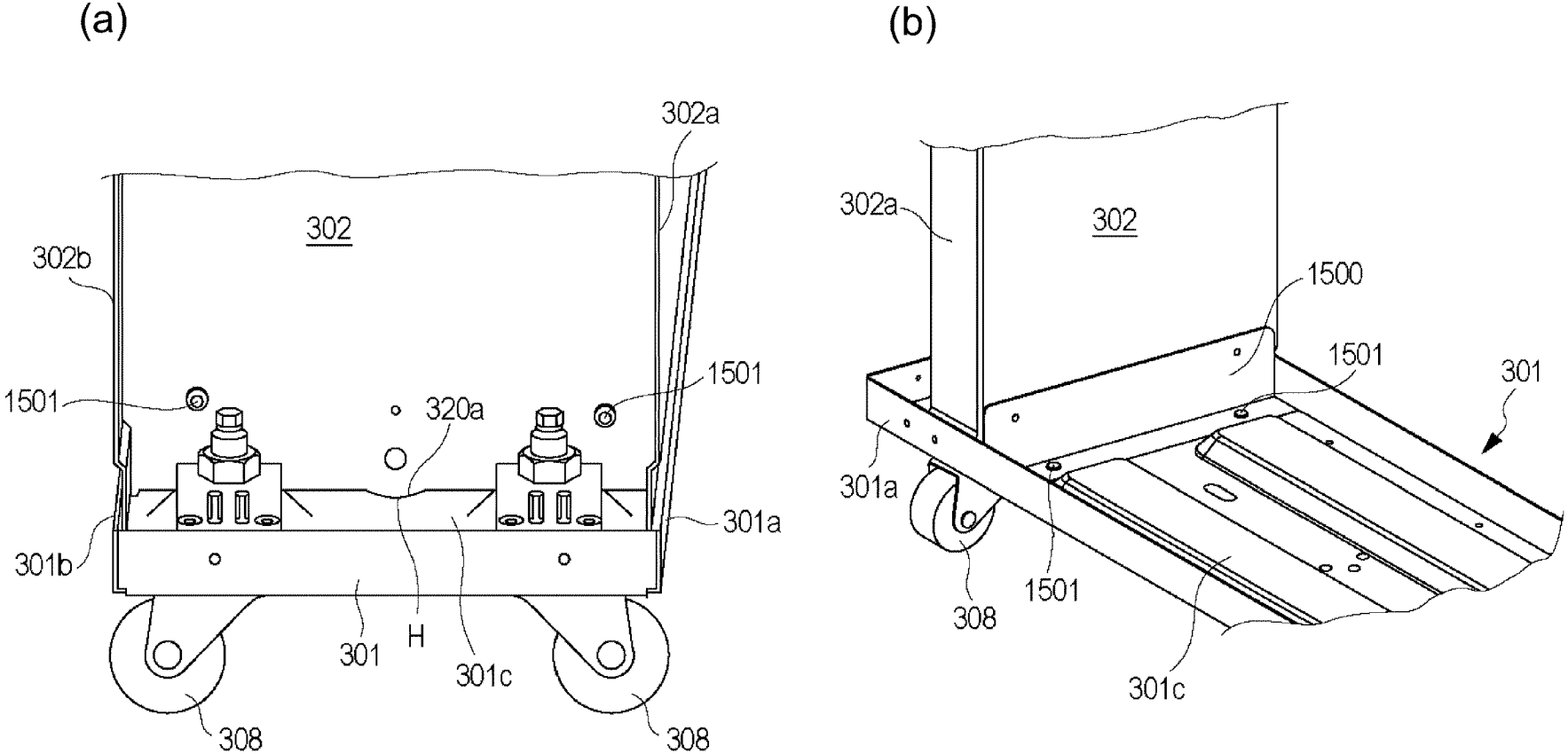

Parts (a) and (b) of FIG. 13 are schematic views for illustrating a supporting frame of a second embodiment.

DESCRIPTION OF THE EMBODIMENTS

Embodiments of the present invention will be specifically described with reference to the drawings. As regards dimensions, materials, shapes and relative arrangement of constituent elements described in the following embodiments, the scope of the present invention is not intended to the limited to the following embodiments.

Embodiment 1

Figure 1:
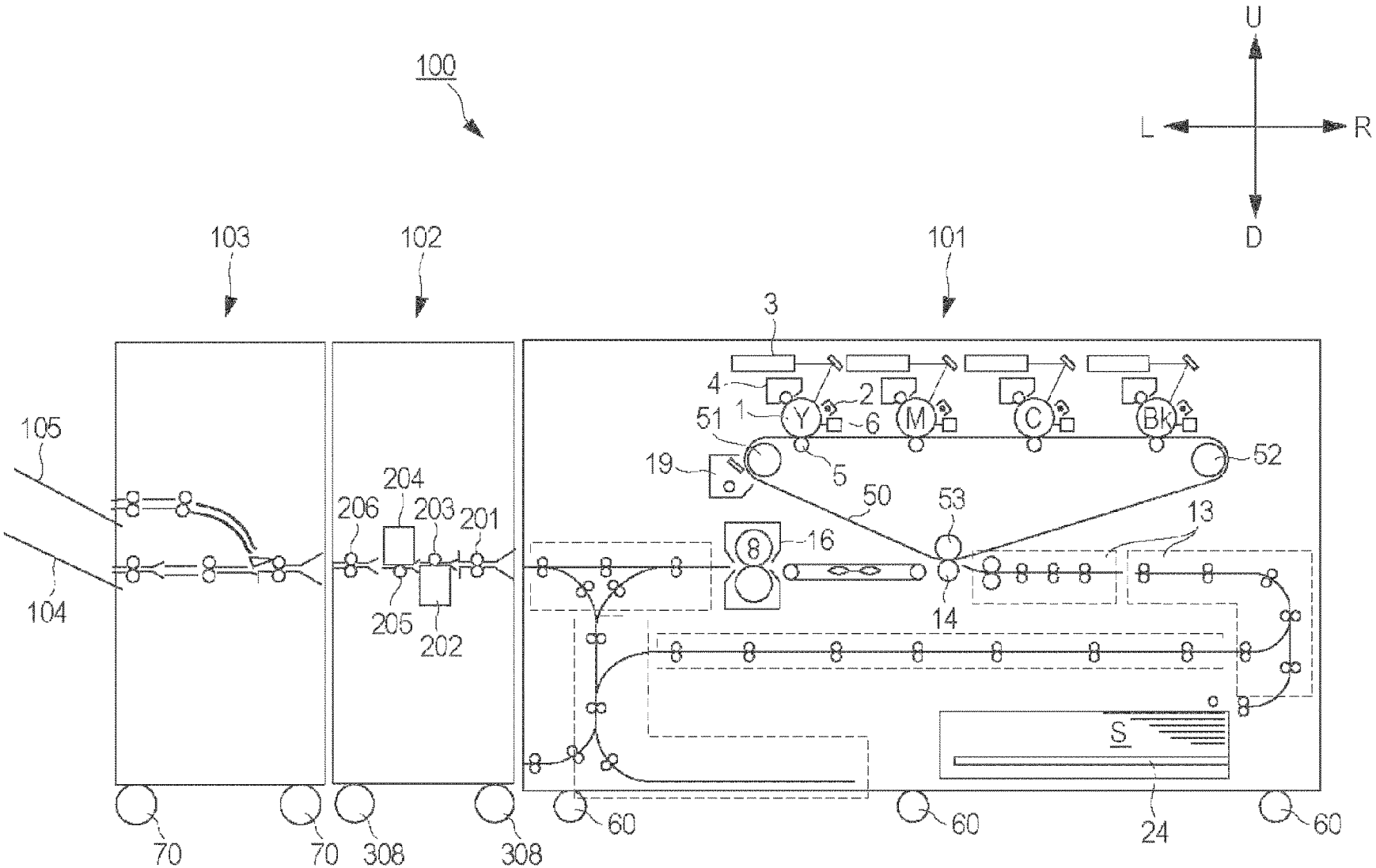
FIG. 1 is a sectional view of an image forming system.

FIG. 1 is a schematic structural view of an image forming system 100 including an image forming apparatus 101, an inspecting device (apparatus) 102 connected thereto and downstream thereof with respect to a recording material feeding direction, and a sorting device (apparatus) 103 connected to the inspecting device 102 and downstream of the inspecting device 102 with respect to the recording material feeding direction. Each of the image forming apparatus 101, the inspecting device 102 and the sorting device 103 is provided with casters disposed on an installing surface and is independently movable.

The image forming apparatus 101 is a four-color-based printer using an electrophotographic process. The image forming apparatus 101 is capable of forming a toner image on a sheet S on the basis of an image signal inputted from an information terminal such as a personal computer or from an unshown external device such as an image reader to an unshown controller. The sheet S is a recording material (or medium) on which the toner image is capable of being formed and includes plain paper, thick paper, an OHP sheet, coated paper, label paper and the like.

Inside the image forming apparatus 101, four image forming portions 10Y, 10M, 10C and 10K for forming toner images of yellow (Y), magenta (M), cyan (C) and black (K), respectively, are provided. These four image forming portions 10 are different in color of toners used, but have similar detailed constitutions, and therefore, the detailed constitution of the image forming portions 10 will be described using the image forming portion 10Y for yellow as an example. The image forming portion 10 includes an electrophotographic photosensitive drum 1 as an image bearing member, a charging device 2, an exposure unit 3, a developing unit 4, a primary transfer roller 5 and a drum cleaner 6. In order to avoid complicatedness of FIG. 1, reference numerals of these constituent elements in the image forming portions 10M, 10C and 10K other than the image forming portion 10Y are omitted from FIG. 1. Further, an electrophotographic process and an image forming operation in each of the image forming portions are well known, and therefore, will be omitted from description.

Under the image forming portions 10, an intermediary transfer belt 50 is provided. The intermediary transfer belt 50 is stretched by a driving roller 51, a tension roller 52, and an inner secondary transfer roller 53, and is driven (rotated) in an arrow J direction in FIG. 1.

The toner image formed on the photosensitive drum 1 in each of the image forming portions 10 is transferred onto the intermediary transfer belt 50 by passing through a primary transfer nip formed by the photosensitive drum 1 and the primary transfer roller 5 of each image forming portion 10 through the intermediary transfer belt 50. Then, the color toner images are transferred superposedly from the photosensitive drums 1 of the respective image forming portions 10 onto the rotating intermediary transfer belt 50 while the intermediary transfer belt 50 rotates. By this, an unfixed color image including the superposed four color toner images of yellow, magenta, cyan and black is formed on the intermediary transfer belt 50.

On the other hand, sheets S are fed one by one from a cassette 24, and the fed sheet S is conveyed along a feeding passage 13 to a secondary transfer nip, at predetermined control timing, formed between the intermediary transfer belt 50 and a secondary transfer roller 14. By this, onto the sheet S, the toner images on the intermediary transfer belt 50 are secondary-transferred. Here, transfer residual toner remaining on the intermediary transfer belt 50 after the secondary transfer of the toner images onto the sheet S is removed from the belt surface by a belt cleaner 19.

Thereafter, the sheet S on which the toner images are transferred is heated and pressed by a fixing device 16, so that the toner images are fixed on the sheet S. The sheet S passed through the fixing device 16 is discharged from the image forming apparatus 101 by a discharging roller pair 17.

The sheet S discharged from the image forming apparatus 101 is delivered to a first feeding roller pair 201 in the inspecting device 102 connected to the image forming apparatus 101 on a side downstream of the image forming apparatus 101 with respect to a sheet feeding direction. At this time, a feeding speed of the sheet S in the first feeding roller pair 201 is the same as a feeding speed in the discharging roller pair 17 of the image forming apparatus 101.

Next, the sheet S is fed to a first contact image sensor (hereinafter referred to as "CIS") unit 202. The first CIS unit 202 is provided as a sensor for reading image information on a back surface of the sheet S. At a position opposing a sheet S passing surface of the first CIS unit 202 with respect to the feeding passage, a first pressing roller 203 is provided. Further, the first pressing roller 203 presses the passing sheet S toward the first CIS unit 202 side by an unshown spring. Further, the first pressing roller 203 rotates at the same feeding speed as the feeding speed of the first feeding roller pair 201 so as to feed the sheet S. Therefore, the first pressing roller 203 presses the sheet S toward the first CIS unit 202 so that the sheet S passing through the first CIS unit 202 passes through a focal position of the first CIS unit 2022 while maintaining a certain distance from the first CIS unit 202, and thus reliably carries out an image reading process on the sheet S by the first CIS unit 202.

On a side downstream of the first CIS unit 202 with respect to the sheet S feeding direction, a second CIS unit 204 and a second pressing roller 205 are provided. The second CIS unit 204 is used for reading image information on a front surface of the sheet S. Here, the second CIS unit 204 has the same constitution and function as those of the first CIS unit 202 disposed upstream of the second CIS unit 204. By employing such a constitution, the inspecting device 102 is capable of reading the image information on the front surface of the sheet S and the image information on the back surface of the sheet S only by causing the sheet S to pass through the inspecting device 102 once.

In this embodiment, a constitution in which the image information on the back surface of the sheet S is read in the first CIS unit 202 disposed on an upstream side of the sheet feeding direction and the image information on the front surface of the sheet S is read in the second CIS unit 204 was employed. Here, the front surface of the sheet S is a first surface on which an image is first formed at the second transfer nip in the image forming apparatus 101. Further, the back surface of the sheet S is a second surface, opposite from the first surface, on which an image is formed by causing the sheet S on which the image is formed on the front surface in the image forming apparatus 101 to pass through the secondary transfer nip after the sheet S is turned upside down in a reverse feeding passage. That is, the front surface of the sheet S is the surface on a side where the sheet S opposes the intermediary transfer belt 50 when the sheet S first passes the secondary transfer nip of the image forming apparatus 101, and the back surface of the sheet S is the surface on a side where the sheet S opposes the intermediary transfer belt 50 when the sheet secondly passes through the secondary transfer nip of the image forming apparatus 101.

In this embodiment, the upstream-side first CIS unit 202 with respect to the sheet feeding direction was used for reading the back surface, and the downstream-side second CIS unit 204 was used for reading the front surface, but a reverse constitution may also be employed. When a constitution in which the first surface of the sheet S discharged from the image forming apparatus 101 is read by one CIS unit and the second surface of the sheet S opposite in side from the first surface of the sheet S is read by the other CIS unit is employed, an arrangement order of the first and second CIS units 202 and 204 with respect to the sheet feeding direction and a direction of the sheet discharged from the image forming apparatus 101 may also be appropriately changed.

Further, the sheet S passed through the second CIS unit 204 is discharged from the inspecting device 102 by being nipped and fed by a second feeding roller pair 206. Here, the first feeding roller pair 201 and the second feeding roller pair 206 are examples of a feeding roller pair capable of nipping and feeding the sheets and examples of a feeding unit.

As shown in FIG. 1, a sheet feeding passage of the inspecting device 102 is substantially horizontal, and therefore, the sheet S is fed substantially horizontally. That is, a nip of the first feeding roller pair 201, a nip between the first CIS unit 202 and the first pressing roller 203, a nip between the second CIS unit 204 and the second pressing roller 205, and a nip of the second feeding roller pair 206 have the substantially same height (level) from an installation surface of the inspecting device 102. Accordingly, the inspecting device 102 is capable of reading the image information without imposing stress on the sheet such that the sheet S fed is bent.

Then, the sheet S discharged from the inspecting device 102 is fed to the sorting device 103 and then is discharged onto either one of trays 104 and 105 by the sorting device 103. By this, a series of operations from the feeding of the sheet S to the discharge of the sheet S in the image forming system 100.

Next, an inspecting process of the sheet S in the image forming system 100 will be described. In the image forming system 100 in this embodiment, the image formed on the sheet S by the image forming apparatus 101 is read by the inspecting device 102, so that presence or absence of an abnormal image for the image formed on the sheet S can be discriminated. Further, the sheet S is discharged by switching the trays 104 and 105 by the sorting device 103, so that a sorting process based on a discrimination result of the presence or absence of the abnormal image can be performed. That is, in the image forming system 100, the image formed by the image forming apparatus 101 is inspected, and then the sorting process depending on an inspection result can be carried out. Here, the inspecting device 102 is an image reading apparatus (device) for reading the image information on the sheet S in order to acquire the image information on the sheet S and is a sheet feeding device for feeding the sheet S in order to read the image information.

In the case where occurrence or non-occurrence of abnormality of the image information on the sheet S outputted from the image forming apparatus 101 in the image forming system 100 in this embodiment, a sheet S on which a reference image is formed is caused to pass through the inspecting device 102, and then image data read by the inspecting device 102 through the first CIS unit 202 and the second CIS unit 204 is registered as reference image data in an external computer connected to the image forming system 100.

Thereafter, the images on the sheet S outputted and fed from the image forming apparatus 101 are read by the first CIS unit 202 and the second CIS unit 204, so that image data are acquired. The external computer compares each of the image data with the registered image data as the reference image data, and the sheet S for which a difference between the read image data and the reference image data is detected is discriminated as being abnormal and then is subjected to the sorting process by the sorting device 103. That is, in the sorting device 103, the sheet S discriminated as being that there is no abnormal image is discharged onto the tray 104, and the sheet S discriminated as being that the abnormal image is present is discharged onto the tray 105, and thus the sorting process is performed.

Incidentally, in this embodiment, discrimination of the presence or absence of the abnormal image for the image data is made by using the external computer in this embodiment, but when the discrimination of the abnormal image can be carried out by the image forming system 100 as a whole, the discrimination of the abnormal image can be carried out by any of the controller. For example, a constitution in which the discrimination of the presence or absence of the abnormal image is made by an unshown controller provided in the image forming apparatus 101 may also be employed. Further, a constitution in which the discrimination of the presence or absence of the abnormal image is made by an unshown controller provided in the inspecting device 102 may also be employed.

Figure 2:
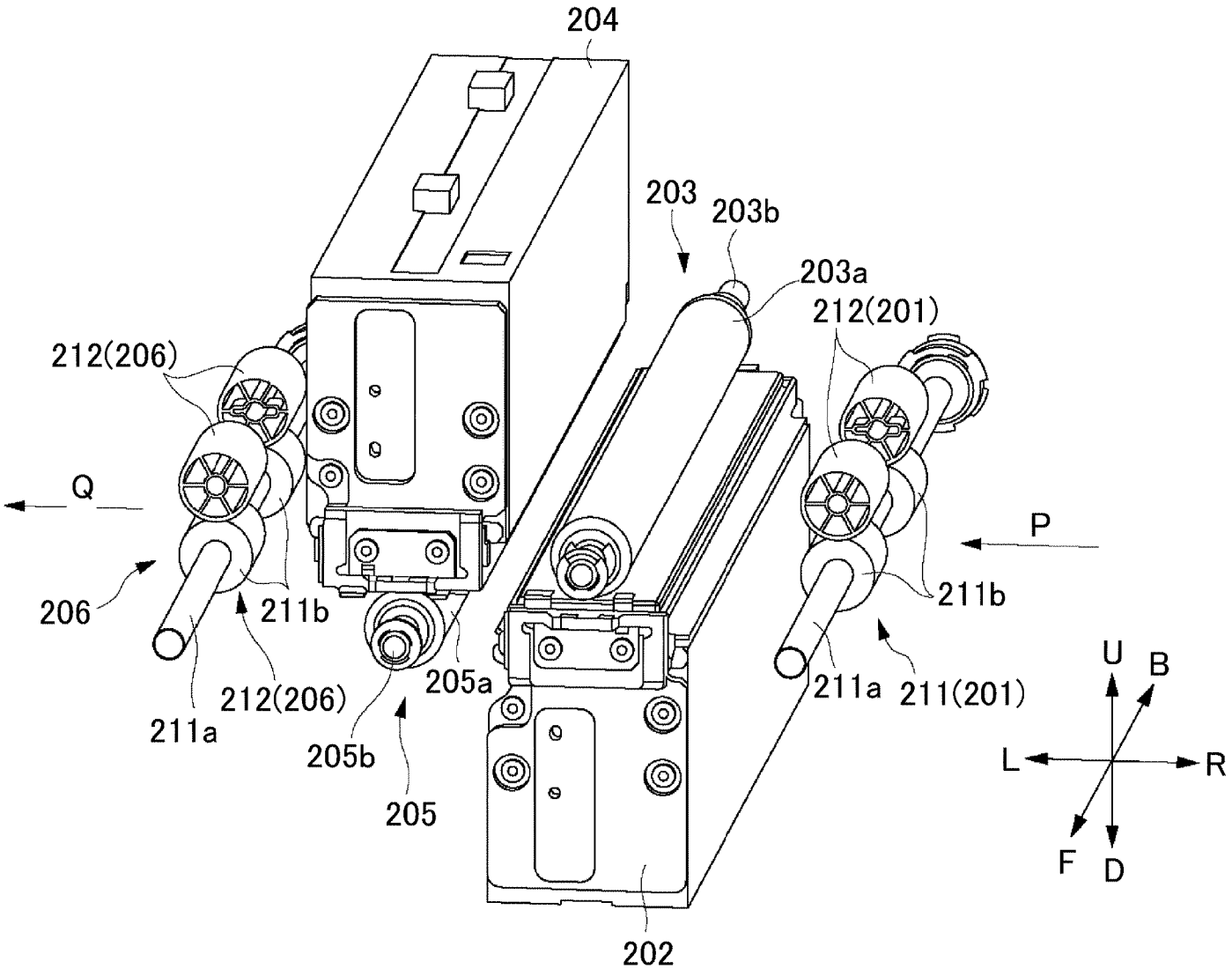
FIG. 2 is a perspective view of an inner unit of an inspecting device.

Next, a structure of inner units of the inspecting device 102 will be described using FIG. 2. FIG. 2 is a perspective view showing the first feeding roller pair 201, the first CIS unit 202, the first pressing roller 203, the second CIS unit 204, the second pressing roller 205 and the second feeding roller pair 206 which are the inner units of the inspecting device 102.

In this embodiment, an arrow F direction shows a front side, an arrow B direction shows a back (rear) side, an arrow R direction shows a right side, an arrow L direction shows a left side, an arrow U direction shows an upward (upper) side, and an arrow d direction shows a downward (lower) side. That is, a left-right direction in FIG. 2 is a left-right direction in FIG. 1, and an up-down direction in FIG. 2 is an up-down direction in FIG. 1. Here, with respect to the up-down direction in FIGS. 1 and 2, a direction from U toward D is a vertical direction.

In FIG. 2, the sheet S enters the first feeding roller pair 201 from an arrow P direction and is discharged toward an arrow Q direction by the second feeding roller pair 206. That is, the sheet feeding direction in the inspecting device 102 is a direction from the right toward the left on the drawing sheet of FIG. 2, and the first feeding roller pair 201 is provided on a side upstream of the first CIS unit 202 and the second feeding roller pair 206 is provided on a side downstream of the second CIS unit 204, with respect to the sheet feeding direction.

The first feeding roller pair 201 includes a feeding roller 211 including a steel shaft 211*a* provided with two silicone rubbers 211*b* of 20 mm in outer diameter and includes a roller 212 made of a POM resin material and mounted on each of the silicone rubbers 211*b* at an associated position.

Here, the feeding roller 211 has a constitution in which rotational drive is given thereto from an unshown driving motor provided on a rear end portion of FIG. 2 through a timing belt and thus the steel shaft 211*a* is rotated. The rollers 212 has a constitution in which an unshown rotation shaft thereof is rotatably shaft-supported and is urged by the feeding roller 211, and thus is rotated by the feeding roller 211.

The first CIS unit 202 includes a transparent glass 202*a* at a surface where the sheet S fed by the first pressing roller 203 is pressed against the transparent glass 202*a*. Further, the first CIS unit 202 is capable of reading the image data by reading the image on the sheet S fed between the transparent glass 202*a* and the first pressing roller 203 through the transparent glass 202*a* by an unshown light source and an unshown light receiving sensor which are provided inside the transparent glass 202*a*.

The first pressing roller 203 is constituted by press-fitting a shaft 203*b* into an aluminum pipe material 203*a* at opposite end portions of the pipe material 203*a* and then by coating an outer peripheral surface of the pipe material 203*a* with a black urethane resin material. The first pressing roller 203 is 20 mm in outer diameter. Further, to a rear end portion of the first pressing roller 203 in FIG. 2, rotational drive is given from an unshown driving motor through a timing belt. Further, to the first pressing roller 203, pressure of 5.9 N is imparted by an unshown spring, so that the first pressing roller 203 is urged toward the first CIS unit 202.

Incidentally, constitutions of the second CIS unit 204 and the second pressing roller 205 are similar to the constitutions of the first CIS unit 202 and the first pressing roller 203, respectively, and therefore, their constituent elements are represented by similar reference numerals or symbols and will be omitted from description. Further, a constitution of the second feeding roller pair 206 is the same as the constitution of the first feeding roller pair 201, and therefore, constituent elements thereof are represented by the same reference numerals or symbols and will be omitted from description.

Here, the first feeding roller pair 201, the second feeding roller pair 206, the first CIS unit 202, the second CIS unit 204, the first pressing roller 203 and the third pressing roller 205 which are the inner units of the inspecting device 102 have to be fixed in a state in which positional accuracy of each of the inner units is maintained. This is because if the positional accuracy is poor and each of the inner units is fixed in an inclined state, the feeding of the sheet S cannot be carried out linearly and thus the sheet S is fed in an obliquely moved state. Thus, when the sheet S is fed in the obliquely moved state, reading of the image data by the first CIS unit 202 and the second CIS unit 204 cannot be properly carried out in some cases, so that there is a liability that the discrimination of the abnormal image cannot be made.

Therefore, in this embodiment, in order to enhance the positional accuracy of the inner units of the inspecting device 102, a constitution in which positional accuracy of a supporting frame for supporting the inner units is enhanced is employed. In the following, the supporting frame will be described.

Parts (a) and (b) of FIG. 3 are perspective views showing a supporting frame 300 of the inspecting device 102, in which a state such that an outer casing cover or the like forming an outer appearance of the inspecting device 102 is removed is shown. Part (a) of FIG. 3 is the perspective view showing the supporting frame 300 in a state in which the inner units are removed, and part (b) of FIG. 3 is the perspective view showing the supporting frame 300 in a state in which the supporting frame 300 supports the inner units. Here, the supporting frame 300 in parts (a) and (b) of FIG. 3 is viewed from a side of a rear-side plate 303 provided on a rear surface side B of the inspecting device 102.

The supporting frame 300 of the inspecting device 102 is constituted by a bottom plate 301, a front-side plate 302, the rear-side plate 303, a right rail stay 304, a left rail stay 305, a link stay 306 and a stay 307.

Each of the front-side plate 302 and the rear-side plate 303 is fixed to the bottom plate 301. Details of a fixing structure of the supporting frame 300 will be described later. Each of the right rail stay 304, the left rail stay 305, the link stay 306 and the stay 307 is fixed to the front-side plate 302 on one end side and is fixed to the rear-side plate 303 on the other end surface with respect to a longitudinal direction (front-rear direction FR).

Four casters 308 are device on a lower surface of the bottom plate 301 with respect to a plate thickness direction, i.e., on an installation surface side of the bottom plate 301 so that the two casters 308 and other two casters 308 are positioned on the front side and the rear side, respectively. Thus, by the plurality of casters 308, the inspecting device 102 is movable on the installation surface.

Further, as shown in FIG. 1, the image forming apparatus 101 is provided with a plurality of casters 60, and the sorting device 103 is provided with a plurality of casters 70. By this, each of the devices (apparatuses) in the image forming system is independently movable. That is, the inspecting device 102 is movable separately from the image forming apparatus 101 and the sorting device 103 in the image forming system 100.

Further, the inspecting device 102 is provided with a fall-preventing caster 311 in addition to the casters 308. The fall-preventing caster 311 is used for suppressing a fall of the inspecting device 102 in a left-right direction LR when the inspecting device 102 is moved by using the casters 308. Further, the fall-preventing caster 311 is rotatable relative to the bottom plate 301, and is accommodated below the bottom plate 301 in the case where the inspecting device 102 is connected to the image forming apparatus 101 in the image forming system 100 on a side downstream of the image forming apparatus 101 with respect to the sheet feeding direction.

As shown in part (b) of FIG. 3, as the inner units of the inspecting device 102, each of the above-described first feeding roller pair 201 and second feeding roller pair 206 is rotatably fixed to the front-side plate 302 on one end side with respect to the longitudinal direction and is rotatably fixed to the rear-side plate 303 on the other end side with respect to the longitudinal direction. For example, the feeding roller 211 is rotatably fixed to the front-side plate 302 at one end side portion with respect to the rotational axis direction of the steel shaft 211*a* than the silicone rubbers 211*b* are, and is rotatably fixed to the rear-side plate 303 at the other end side portion opposite from the one end side portion with respect to the rotational axis direction than the silicone rubbers 211*b* are. For this reason, the front-side plate 302 and the rear-side plate 303 are provided with supporting horizontals through which end portions the steel shaft 211*a* of the feeding roller 211 on one end side and the other end side penetrate.

Further, each of the first CIS (sensor) unit 202, the second CIS (sensor) unit 204, the first pressing roller 203 and the second pressing roller 205 which are used as the inner units of the inspecting device 102 is supported by an inner unit frame 400. The inner unit frame 400 is fixed to the front-side plate 302 on one end side with respect to the longitudinal direction (front-rear direction frame) and is fixed to the rear-side plate 303 on the other end side with respect to the longitudinal direction. Accordingly, each of the front-side plate 302 and the rear-side plate 303 is provided with an opening through which the inner unit frame 400 is supported and inserted.

The inner unit frame 400 is capable of being inserted into and extracted from the supporting frame 300 through the opening provided in the front-side plate 302 by being slid (moved) on the right rail stay 304 and the link stay 306 when the inner unit frame 400 is mounted in and dismounted from the supporting frame 300. Thus, the inner unit frame 400 which is heavy can be easily mounted in and dismounted from the supporting frame 300.

As shown in FIG. 3, the supporting frame 300 of the inspecting device 102 has a length with respect to the vertical direction (arrow UD direction) longer than a length with respect to the sheet S feeding direction (arrow RL direction, widthwise direction). That is, when a length of the front-side plate 302 (rear-side plate 303) with respect to the horizontal direction (widthwise direction) is X, X is 237 mm, and when a length from a fixing position between the rear-side plate 303 and the bottom plate 301 to a position where the feeding roller pairs 201 and 206 are supported is Y, Y is 664 mm. That is, a constitution in which the length Y from the contact position between the rear-side plate 303 and the bottom plate 301 to the nip of the first feeding roller pair 201 forming a feeding passage along which the sheet S is fed is two times or more longer than the length X with respect to the widthwise direction of the supporting frame 300 is employed.

Further, as regards the front-side plate 302 and the rear-side plate 303, a maximum length with respect to the vertical direction is two times or more a maximum length with respect to the horizontal direction, and therefore, also as regards the supporting frame 300, a maximum length with respect to the vertical direction is two times or more a maximum length with respect to the horizontal direction.

As described above, the nip position of the first feeding roller pair 201 and the nip position of the second feeding roller pair 206 are substantially equal in height (level) to each other for forming a substantially horizontal feeding passage so that the fed sheet is not bent.

Here, in the inspecting device 102, the position of each of the first feeding roller pair 201 and the second feeding roller pair 206 with respect to the vertical direction relative to the front-side plate 302 and the rear-side plate 303 is determined by a position of a sheet discharge opening of the image forming apparatus 101 and a sheet receiving opening of the sorting device 103.

Further, a length of the inspecting device 102 with respect to the widthwise direction is determined by a length of the feeding passage. Here, in order to shorten a discharging time from feeding of the sheet S in the image forming system 100 to discharge onto the tray 104 or 105, it is desirable that a feeding path in the inspecting device 102 is short to the extent possible. In order to meet such a demand, the inspecting device 102 in this embodiment has the length with respect to the widthwise direction shorter than the length with respect to the vertical direction in order to realize a necessary minimum feeding passage length. That is, the length of the supporting frame 300 of the inspecting device 102 is shorter with respect to the widthwise direction than with respect to the vertical direction.

Here, in the case where flatness of the bottom plate 301 is low and the bottom plate 301 is inclined relative to the horizontal surface, the front-side plate 302 and the rear-side plate 303 which are fixed to the bottom plate 301 are in a state in which these plates are inclined relative to a vertical surface. Such a problem will be described using FIG. 4. Parts (a) to (c) of FIG. 4 are schematic views for illustrating inclination of the front-side plate 302 and the rear-side plate 303, in which part (a) shows a state of no inclination, part (b) shows a state in which the front-side plate 302 and the rear-side plate 303 are inclined in the same direction at the same angle, and part (c) shows a state in which the front-side plate 302 is inclined relative to the rear-side plate 303. In this embodiment, it is assumed that each of the front-side plate 302 and the rear-side plate 303 is fixed so that an interval therebetween at an upper end portion and an interval therebetween at a lower end portion are equal to each other.

As shown in part (a) of FIG. 4, in the case where the flatness of the bottom plate 301 is high and the inclination such as warpage or distortion of the bottom plate 301 is not generated, the front-side plate 302 and the rear-side plate 303 are not inclined, and therefore, the inner units supported by the front-side plate 302 and the rear-side plate 303 are not inclined. Accordingly, a parallel state between the steel shaft 211*a* supporting the silicone rubbers 211*b* and the rotation shaft of the rollers 212 of the first feeding roller pair 201 is maintained. That is, a parallel state between the rotation shafts of the rotatable members is maintained so that parallelism between the rotation shafts of the rotatable members is high.

At this time, in the case where the bottom plate 301 is not inclined and thus the front-side plate 302 and the rear-side plate 303 are not inclined, the second feeding roller pair 206 is also similarly in a state in which parallelism between associated rotatable members is maintained. In this case, the sheet fed by the first feeding roller pair 201 and the second feeding roller pair 206 is not obliquely moved, so that the images on the sheet can be properly read by the first CIS unit 202 and the second CIS unit 204.

Further, as shown in part (b) of FIG. 4, in the case where the inclination such as the warpage or the distortion of the bottom plate 301 is generated and in the case where in the bottom plate 301, a front end portion to which the front-side plate 302 is fixed and a rear end portion to which the rear-side plate 303 is fixed are inclined at the same angle, the front-side plate 302 and the rear-side plate 303 are inclined in the same direction at the same angle. In this case, the inner units supported by the front-side plate 302 and the rear-side plate 303 are supported while following the inclination of the front-side plate 302 and the rear-side plate 303.

However, the structure shown in part (b) of FIG. 4 is in a state in which the front-side plate 302 and the rear-side plate 303 are inclined in the same direction at the same angle, and therefore, similarly as in the structure shown in part (a) of FIG. 4, a parallel state between the steel shaft 211*a* supporting the silicone rubbers 211*b* and the rotation shaft of the rollers 212 of the first feeding roller pair 201 is maintained. That is, a parallel state between the rotation shafts of the rotatable members is maintained so that parallelism between the rotation shafts of the rotatable members is high.

Thus, even in the case where the bottom plate 301 is not inclined and thus the front-side plate 302 and the rear-side plate 303 are not inclined, the second feeding roller pair 206 is also similarly in a state in which parallelism between the rotation shafts of associated rotatable members is maintained in a high state. Also, in this case, the sheet fed by the first feeding roller pair 201 and the second feeding roller pair 206 is not obliquely moved, so that the images on the sheet can be properly read by the first CIS unit 202 and the second CIS unit 204.

Thus, in the case where the front-side plate 302 and the rear-side plate 303 are not inclined relative to each other as shown in part (a) of FIG. 4 and in the case where the front-side plate 302 and the rear-side plate 303 are inclined in the same direction at the same angle, the fed sheet does not cause oblique movement. This is because parallelism between the rotation shafts supporting the rotatable member pairs comprising the first feeding roller pair 201 and the second feeding roller pair 206. That is, the position where the first feeding roller pair 201 and the second feeding roller pair 206 are supported by the front-side plate 302 and the position where the first feeding roller pair 201 and the second feeding roller pair 206 are supported by the rear-side plate 303 do not provide differences with respect to the vertical direction and the left-right direction.

On the other hand, as shown in part (c) of FIG. 4, in the case where the inclination such as the warpage or the distortion of the bottom plate 301 in the case where inclination of the front end portion of the bottom plate 301 where the front-side plate 302 is fixed and inclination of the rear end portion of the bottom plate 301 where the rear-side plate 303 is fixed are different from each other, the front-side plate 302 and the rear-side plate 303 follow the bottom plate 301 and are inclined at different angles.

Here, in part (c) of FIG. 4, the side plate 301 indicated by a solid line and the casters 308 show the front end portion supporting the front-side plate 302, and the bottom plate 301 indicated by a broken line and the casters 308 show the rear end portion of the rear-side plate 303. In this case, the inner units supported by the front-side plate 302 and the rear-side plate 303 are also supported in a state in which the inner units follows the inclination of the front-side plate 302 and the rear-side plate 303 and thus are inclined.

Thus, in the case where the front-side plate 302 and the rear-side plate 303 are inclined at different angles, the first feeding roller pair 201 and the second feeding roller pair 206 cause a difference between the position where these feeding roller pairs are supported by the front-side plate 302 and the position where these feeding roller pairs are supported by the rear-side plate 303 with respect to the vertical direction and the left-right direction. In this case, in the first feeding roller pair 201, the parallel state between the steel shaft 211*a* supporting the silicone rubbers 211*b* and the rotation shaft of the rollers 212 is collapsed.

That is, the first feeding roller pair 201 is in the state in which the parallel state between the rotation shafts of the associated rotatable members is collapsed and in a state in which parallelism therebetween is low. Similarly, the second feeding roller pair 206 is also in the state in which the parallel state between the rotation shafts of the associated rotatable members is collapsed and in the state in which the parallelism therebetween is low.

Further, as in this embodiment, in the case where the length of the associated side plate with respect to the vertical direction is longer than the length of the side plate with respect to the widthwise direction which is the sheet feeding direction, these problems occur more conspicuously. Specifically, the positions where the first feeding roller pair 201 and the second feeding roller pair 206 are supported for forming the feeding passage are separated from the position of the bottom plate 301, and therefore, a deviation amount between the positions where the first feeding roller pair 201 and the second feeding roller pair 206 are supported becomes larger than a positional deviation amount between the front end portion and the rear end portion of the bottom plate 301.

That is, in the case where the bottom plate 301 is inclined, positional deviation between the front-side plate 302 and the rear-side plate 303 at the positions corresponding to the feeding passage with respect to the vertical direction occurs in an amount larger than positional deviation therebetween at the front end portion of the bottom plate 301, so that a difference in inclination between the positions corresponding to the feeding passage with respect to the vertical direction becomes large.

For example, in the case where the flatness of the bottom plate 301 is 0.8, heights of the front end portion and the rear end portion of the bottom plate 301 are deviated from each other so that positions of horizontals formed in the front-side plate 302 and the rear-side plate 303 for supporting the rotation shaft of the first feeding roller pair 201 are deviated from each other by about 2.2 mm. Thus, the positions of the horizontals for supporting the rotation shaft of the first feeding roller pair 201 are deviated between the front and rear side plates, so that the steel shaft 211*a* and the rotation shaft of the rollers 212 are in a distorted state (in which the parallelism is low) so that these shafts cross each other. By this, when the rotation shaft of the rotatable members of the first feeding roller pair 201 are in the distorted state, the sheet S is fed in a largely curved manner. That is, the sheet S fed by the first feeding roller pair 201 was obliquely moved in some cases.

Thus, in the image forming system 100 including the inspecting device 102, although the image formation originally on the sheet S by the image forming apparatus 101 is the same as the image acquired as the reference image, this image is discriminated as an image different from the reference image by the discriminating portion, so that there was a liability that the image is discriminated as a defective (inconvenient) image.

Therefore, in this embodiment, a constitution of the supporting frame 300 capable of suppressing occurrence of a difference in angle with respect to an inclination direction and the vertical direction between the pair of side plates consisting of the front-side plate 302 and the rear-side plate 303 supporting the inner units even in the case where the inclination such as the warpage or the distortion of the bottom plate 301 will be described.

First, the front-side plate 302 in this embodiment will be described using FIGS. 5 and 6. FIG. 5 is a sectional view showing a relationship between the bottom plate 301 and the front-side plate 302 in FIG. 3. Parts (a) and (b) of FIG. 6 are perspective views of the front-side plate 302, in which part (a) shows the front-side plate 302 as viewed from a first bent and erected portion 321 side, and part (b) shows the front-side plate 302 as viewed from a second bent and erected portion 322 side.

The bottom plate 301 is provided with a first bent and erected portion 301*a* and a second bent and erected portion 301*b* on opposite sides with respect to the widthwise direction, of the inspecting device 102, which is the sheet feeding direction. Each of the first bent and erected portion 301*a* and the second bent and erected portion 301*b* is formed by being bent and erected substantially perpendicular to a bottom portion 301*c*.

The front-side plate 302 is constituted so as to include front-side surface portion 320 and the first bent and erected portion 321 and the second bent and erected portion 322 which are bent and erected substantially perpendicular to the front-side portion 320. Further, the front-side surface portion 320 of the front-side plate 302 is provided with a projected portion 320*a* projected downward with respect to the vertical direction than lower end portions of the first bent and erected portion 321 and the second bent and erected portion 322 are. Further, the projected portion 320 of the front-side surface portion 320 is constituted so as to contact the bottom portion 301*c* at a contact portion H. That is, with respect to a plate thickness direction of the bottom portion 301*c* of the bottom plate 301, the projected portion 320*a* contacts a surface of the bottom plate 301 on a side opposite from a surface of the bottom plate 301 on which the casters 308 are mounted.

Further, as shown in FIGS. 5 and 6, the projected portion 320*a* has a substantially V-shape. Here, the substantially V-shape includes are having a free end portion (lower end portion) which has an arcuate shape, not an acute-angled shape as shown in these figures. The shape of the free end portion of the projected portion 320*a* in this embodiment is the arcuate shape of 18.4 mm in radius of curvature.

The front-side plate 302 is positioned between the first bent and erected portion 301*a* and the second bent and erected portion 301*b*, and the first bent and erected portion 321 is fixed to the first bent and erected portion 301*a* and the second bent and erected portion 322 is fixed to the second bent and erected portion 301*b*, so that the front-side plate 302 is fixed to the bottom plate 301.

Here, in a state in which the front-side plate 302 is fixed to the bottom plate 301, a contact point between the bottom portion 301*c* of the bottom plate 301 and the front-side plate 303 is only the contact portion H. That is, the front-side plate 301 point-contacts the bottom portion 301*c* at the contact portion H. Therefore, the lower end portion (first end portion) of the first bent and erected portion 321 with respect to the vertical direction and the bottom portion 301*c* do not contact each other, so that a gap M is formed between the lower end portion (first end portion) of the first bent and erected portion 321 with respect to the vertical direction and the bottom portion 301*c*.

Further, the lower end portion (second end portion) of the second bent and erected portion 322 with respect to the vertical direction and the bottom portion 301*c* do not contact each other, so that a gap N is formed between the lower end portion (second end portion) of the second bent and erected portion 322 with respect to the vertical direction and the bottom portion 301*c*. Here, in this embodiment, each of the gaps M and N is about 1.0 mm. That is, as shown in FIG. 6, with respect to a direction in which a bending edge line formed between the front-side portion 320 of the front-side plate 302 and the first bent and erected portion 321 extends, the lower end portions of the first bent and erected portion 321 and the second bent and erected portion 322 are positioned above the projected portion 320*a*. Further, with respect to a direction in which a bending edge line formed between the front-side surface portion 320 and the second bent and erected portion 322 extends, the lower end portions of the first bent and erected portion 321 and the second bent and erected portion 322 are positioned above the projected portion 320*a*. In other words, with respect to the direction in which the bending edge line formed between the front-side surface portion 320 and the first bent and erected portion 321 extends, the projected portion 320*a* projects in a downward direction (direction toward the bottom portion 301*c* of the bottom plate 301) than the first bent and erected portion 321 and the second bent and erected portion 322 are.

Further, in a state before the front-side plate 302 and the bottom plate 301 are fixed to each other, with respect to the widthwise direction of the inspecting device 102 and the supporting frame 300, a gap E is formed between the first bent and erected portion 321 of the front-side plate 302 and the first bent and erected portion 301*a* of the bottom plate 301. Further, in this state, a gap D is formed between the second bent and erected portion 322 of the front-side plate 302 and the second bent and erected portion 301*b* of the bottom plate 301. Here, in this embodiment, each of the gaps D and E is about 0.3 mm.

Thus, between the front-side plate 302 and the bottom plate 301, the gaps M, N, D and E are provided, and therefore, in the state before the front-side plate 302 and the bottom plate 301 are fixed to each other, the front-side plate 302 is swingable about the contact portion H in an arrow W direction. That is, the projected portion 320*a* of the front-side plate 302 is provided at a substantially central portion of the front-side plate 302 with respect to the widthwise direction (angle LR direction). For this reason, the front-side plate 302 is swingable about the substantially central portion with respect to the widthwise direction in the state before being fixed to the bottom plate 301.

Here, the above-described point contact between the front-side plate 302 and the bottom plate 301 at the contact portion H is contact in a degree such that the front-side plate 302 is swingable in the arrow W direction in the state before being fixed to the bottom plate 301, and does not include line contact or the like such that the front-side plate 302 cannot be swung relative to the bottom plate 301.

As shown in part (a) of FIG. 6, a first slit 321*a* is formed between the front-side surface portion 320 and the first bent and erected portion 321. Further, as shown in part (b) of FIG. 6, a second slit 321*a* is formed between the front-side surface portion 320 and the second bent and erected portion 322.

The front-side plate 302 is fixed to the bottom plate 301 with unshown screws inserted in a plurality of first through hole 321*b* formed in the first bent and erected portion 321 and a plurality of second through holes 322*b* formed in the second bent and erected portion 322. Here, the plurality of first through holes 321*b* and the plurality of second through holes 322*b* are top holes for fixing the unshown screws. Here, a flat surface in which the first through holes 321*b* are formed is an example of a first fixing surface, and a flat surface in which the second through holes 322*b* are formed is an example of a second fixing surface. Further, the front-side surface portion 320 is an example of a first supporting surface portion for supporting one end side of the inner units, the first bent and erected portion 321 is an example of the first fixing surface, and the second bent and erected portion 322 is an example of the second fixing surface.

A structure and an assembling procedure of the supporting frame using the thus-constituted front-side plate 302 and bottom plate 301 will be described.

FIG. 7 is a perspective view showing a state in which a rear-side plate right-angled jig 900 is mounted on the bottom plate 301. The rear-side plate right-angled jig 900 includes a triangular right-angled frame 901, and a first horizontal frame 902, a second horizontal frame 903 and a third horizontal frame 904 which extend in the horizontal direction. The right-angled frame 901 is provided with pins 905 and 906 which project toward the bottom plate 301 and engage in positioning holes 301*ca* and 301*cb*, respectively, formed in the bottom portion 301*c* of the bottom plate 301. Here, the positioning hole 301*ca* has a size such that the pin 905 is engageable therein and positioning thereof with respect to the horizontal direction can be carried out. Incidentally, the positioning hole 301*cb* is an elongated hole extending in the front-rear direction of the supporting frame 300 and is capable of positioning the pin 906 with respect to the left-right direction of the supporting frame 300.

Incidentally, the rear-side plate right-angled jig 900 includes a plurality of magnets 908 mounted on the first horizontal frame 902 and a plurality of magnets 909 mounted on the second horizontal frame 903. In this embodiment, three magnets 908 and two magnets 909 are provided. Further, the plurality of magnets 908 and 909 attract the rear-side plate 303, so that the rear-side plate 303 is held perpendicular to the bottom portion 301*c* of the bottom plate 301. That is, by the rear-side plate right-angled jig 900, a perpendicular state between the rear-side plate 303 and the bottom plate 301 can be ensured.

Further, the third horizontal frame 904 is provided with a plurality of magnets 910 mounted thereon, and the magnets 900 attract the front-side plate 302, so that the front-side plate 302 can be positioned relative to the bottom plate 301.

FIG. 9 shows a state in which the rear-side plate 303 is mounted on the structure shown in a state of FIG. 7. The rear-side plate 303 includes a perpendicular surface portion 303*a* in which supporting holes for supporting the inner units are formed, side surface portions 303*b* and 303*c* substantially bent and erected from the perpendicular surface portion 303*a*, and a bottom portion 303*d* substantially bent and erected from the perpendicular surface portion 303*a* and the side surface portions 303*b* and 303*c*. In a state shown in FIG. 8, the fine magnets in total of the plurality of magnets 908 and 909 shown in FIG. 7 attract the perpendicular surface portion 303*a* of the rear-side plate 303, so that the rear-side plate 303 is held substantially perpendicular to the bottom plate 301. Incidentally, the perpendicular surface portion 303*a* is an example of a second supporting surface portion supporting the inner units on the other end side, and the bottom portion 303*d* is an example of a bottom fixing portion.

Further, in a state in which the rear-side plate 303 is held by the rear-side plate right-angled jib 900, the rear-side plate 303 is fastened with screws 309, so that the bottom portion 303*d* of the rear-side plate 303 and the bottom portion 301*c* of the bottom plate 301 are fixed to each other. Thereafter, the rear-side plate 303 is fastened with screws 310, so that the first bent and erected portion 301*a* and the second bent and erected portion 301*b* of the bottom plate 301 and the side surface portion 303*b* and the side surface portion 303*c* of the rear-side plate 303 are fixed, respectively, to each other. By this, the rear-side plate 303 is fixed to the bottom plate 301 in a state in which a right-angled state thereof is ensured.

FIG. 9 shows a state in which the front-side plate 302, the right rail stay 304 and the left rail stay 305 are mounted on the structure shown in FIG. 8. In the state of FIG. 9, the rear-side plate 302 and each of the right rail stay 304 and the left rail stay 305 are fixed to each other by being fastened with unshown screws. Incidentally, in the state of FIG. 9, the front-side plate 302 is not fixed to the bottom plate 301, and a state in which the bottom portion 301*c* of the bottom plate 301 and the projected portion 320*a* are in a contact state with each other at the contact portion H in a state in which the front-side plate 302 is held by the plurality of magnets 910 is formed.

Here, the rear-side plate 303 is provided with jig inserting holes 350 and 351 at an upper portion thereof. Here, the jig inserting hole 350 is a through hole having a circular shape, and the jig inserting hole 351 is a through hole having an elongated shape extending in the sheet feeding direction (widthwise direction of the inspecting device 102). Further, the front-side plate 302 is provided with a jig inserting hole 352 at an upper portion thereof. Here, the jig inserting hole 352 is a through hole having a circular shape.

FIG. 10 shows a front-side plate positioning jig 120. The front-side plate positioning jig 120 is provided with pins 121, 122 and 123. Each of these pins 121, 122 and 123 is provided with satisfactory right-angled accuracy. That is, the pins 121, 122 and 123 are arranged so that a phantom line connecting the pins 121 and 122 and a phantom line connecting the pins 121 and 123 are perpendicular to each other. Further, the pins 121 and 122 are engaged in the positioning holes 350 and 351, respectively, provided at the upper portion of the rear-side plate 303 shown in FIG. 9, and the pin 123 is engaged in the positioning hole 352 provided at the upper portion of the front-side plate 302 shown in FIG. 9.

FIG. 11 shows a state in which the front-side plate positioning jig 120 is set on the structure shown in FIG. 9.

By the front-side plate positioning jig 120, the position of the front-side plate 302 can be adjusted on the basis of the rear-side plate 303 fixed to the bottom plate 301. That is, in the state in which the front-side plate positioning jib 120 is mounted, the front-side plate 302 swings about the contact portion H, as a rotation center, between the projected portion 320*a* and the bottom plate 301 in the arrow W direction shown in FIG. 5 relative to the bottom plate 301 and the rear-side plate 303 as described with reference to FIG. 6.

Thus, the front-side plate 302 is swung relative to the bottom plate 301 and the rear-side plate 303, whereby inclination of the front-side plate 302 relative to the rear-side plate 303 can be adjusted. Thus, by adjusting the inclination of the front-side plate 302 relative to the rear-side plate 303 fixed in a state in which the rear-side plate 303 is maintained in a right-angled state with the bottom plate 301 by the rear-side plate right-angled jig 900, adjustment can be made so that inclination directions and inclination angles of the front-side plate 302 and the rear-side plate 303 are equal to each other, respectively.

Further, in a state in which the inclination direction and angle of the front-side plate 302 relative to the rear-side plate 303 are adjusted, the front-side plate 302 and the bottom plate 301 are fixed to each other by being fastened with screws. Specifically, the first bent and erected portion 321 of the front-side plate 302 and the first bent and erected portion 301*a* of the bottom plate 301 are fixed by screws 131, and the second bent and erected portion 322 of the front-side plate 302 and the second bent and erected portion 301*b* of the bottom plate 301 are fixed by screws 131. By this, the front-side plate 302 is fixed to the bottom plate 301 in a state in which positional deviation between the front and rear side plates 302 and 303 caused due to differences in inclination direction and inclination angle of the front-side plate 302 relative to the rear-side plate 303 is suppressed.

Then, the front-side plate 302 and each of the right rail stay 304 and the left rail stay 305 are fixed to each other by being fastened with screws.

In this embodiment, a constitution in which when the bottom plate 301 and the front-side plate 302 are fixed to each other with the screws, these plates are fixed by the screws with respect to only the horizontal direction is employed. That is, the front-side plate 302 is not directly fastened to the bottom portion 301*c* of the bottom plate 301, but is fastened to only the first bent and erected portion 301*a* and the second bent and erected portion 301*b*. This is because when the front-side plate 302 is directly fixed to the bottom portion 301*c* of the bottom plate 301, in the case where inclination such as warpage or distortion generates in the bottom plate 301, the inclination of the bottom plate 301 has the influence on the fixing of the front-side plate 302 on the bottom plate 301 and thus it is required that inclination of the front-side plate 302 relative to the rear-side plate 303 is suppressed.

Incidentally, as described above with reference to FIGS. 5 and 6, with respect to the widthwise direction of the inspecting device 102 and the supporting frame 300, the gap E is provided between the first bent and erected portion 321 of the front-side plate 302 and the first bent and erected portion 301*a* of the bottom plate 301. Further, in this state, the gap D is provided between the second bent and erected portion 322 of the front-side plate 302 and the second bent and erected portion 301*b* of the bottom plate 301. Further, the slit 321*a* is formed between the front-side surface portion 320 and the first bent and erected portion 321 of the front-side plate 302, the slit 322*a* is formed between the front-side surface portion 320 and the second bent and erected portion 322 of the front-side plate 302. By this, in the case where the front-side plate 302 and the bottom plate 301 are fixed with the screws, a constitution in which the first bent and erected portion 321 and the second bent and erected portion 322 of the front-side plate 302 are fixed to the first bent and erected portion 301*a* and the second bent and erected portion 301*b* of the bottom plate 301, respectively, by flexing or bending free end-side regions where the slits 321*a* and 322*a* are formed with respect to the vertical direction is employed. Thus, by providing the slits 321*a* and 322*a*, even in a constitution in which the above-described gaps D and E are formed between the front-side plate 302 and the bottom plate 301, each of free end portions of the first bent and erected portion 321 and the second bent and erected portion 322 can be flexed by a fastening force of the screws when the front-side plate 302 and the bottom plate 301 are fastened with the screws, and therefore, the front-side plate 302 and the bottom plate 301 can be easily fastened to each other.

FIG. 12 shows the supporting frame 300 in a state in which the front-side plate positioning jig 120 and the rear-side plate right-angled jig 900 are dismounted, and shows a state in which the link stays 306 and the stays 307 are fixed to each of the front-side plate 302 and the rear-side plate 303. Incidentally, FIG. 12 shows a state in which the supporting frame 300 of the inspecting device 102 is completed.

As described above, the front-side plate 302 is not directly fixed to the bottom portion 301*c* of the bottom plate 301, and therefore, even in the case where the inclination such as the warpage or the distortion generates in the bottom portion 301*c*, the influence of the inclination of the bottom portion 301*c* is not readily exerted on the front-side plate 302.

Further, the front-side plate 302 is fixed to the first bent and erected portion 301*a* and the second bent and erected portion 301*b* of the bottom plate 301 in a state in which the inclination direction and the inclination angle thereof relative to the rear-side plate 303 and adjusted, and therefore, it is possible to suppress that the inclination direction and the inclination angle are different between the front-side plate 302 and the rear-side plate 303 by the influence of the flatness of the bottom plate 301.

Further, thus it is possible to suppress that the inclination direction and the inclination angle are different between the front-side plate 302 and the rear-side plate 303, and therefore, it is possible to suppress that the inner units supported by each of the front-side plate 302 and the rear-side plate 303 are supported in an inclined state. Therefore, it is possible to suppress that a distance between a position where the first feeding roller pair 201 and the second feeding roller pair 206 are supported by the front-side plate 302 and a position where the first feeding roller pair 201 and the second feeding roller pair 206 are supported by the rear-side plate 303 is caused with respect to each of the vertical direction and the left-right direction. That is, it is possible to suppress that the hole positions for supporting the rotation shaft of the first feeding roller pair 201 provided in the front-side plate 302 and the rear-side plate 303 are deviated from each other and thus the rotation shaft is in a distorted state (state in which the parallelism is low) so that the steel shaft 211*a* and the rotation shaft of the rollers 212 cross each other. As a result, oblique movement of the sheet fed by the first feeding roller pair 201 can be suppressed. Accordingly, in the image forming system 100 including the above-described inspecting device 102, it is possible to suppress that although the image formed originally on the sheet by the image forming apparatus 101 is the same as the image acquired as the reference image, the image is discriminated as an image different from the reference image by the discriminating portion and is classified as a defective image.

Second Embodiment

Next, a second embodiment will be described using FIG. 13. Incidentally, in the second embodiment, constituent elements are similar to those in the first embodiment except that the fixing position of the front-side plate 302 relative to the bottom plate 301 is different from that in the first embodiment, and therefore, are represented by the same reference numerals or symbols and will be omitted from description.

In the second embodiment, a fixing-metal plate 1500 for fixing the front-side plate 302 to the bottom plate 301 is provided. The fixing metal plate 1500 is fixed to the bottom plate 301 by being fastened to the bottom plate 301 with screws.

Further, similarly as in the first embodiment, the front-side plate 302 is adjusted in inclination direction and inclination angle relative to the rear-side plate 303, and thereafter is fixed to the fixing plate 1500 by being fastened with screws 1501.

Also, in this constitution, similarly as in the first embodiment, the front-side plate 302 contacts the bottom portion 301*c* of the bottom plate 301 by the projected portion 320*a* of the front-side surface portion 320, but the first bent and erected portion 321 and the second bent and erected portion 322 do not contact the bottom portion 301*c*. By this constitution, the front-side plate 302 is capable of swinging about the contact point H between the projected portion 320*a* and the bottom portion 301*c* in the arrow W direction (see FIG. 5), so that adjustment of inclination of the front-side plate 302 relative to the rear-side plate 303 by using the jigs is easily performed.

Further, the front-side plate 302 subjected to the adjustment of the inclination direction and the inclination angle relative to the rear-side plate 303 can be fixed to the bottom plate 301 by the fixing plate 1500, and therefore, it is possible to suppress that there arises a difference in inclination direction and inclination angle between the front-side plate 302 and the rear-side plate 303. At this time, of mounting holes through which the screws 1501 are inserted, either one of the mounting holes of the fixing metal plate 1500 and the front-side plate 302 is provided as an elongated hole, so that the front-side plate 302 after the angle adjustment is performed can be fixed to the fixing metal plate 1500.

Thus, also in the second embodiment, the front-side plate 302 is not directly fixed to the bottom portion 301*c* of the bottom plate 301 but is fixed to the bottom portion 301*c* through the fixing metal plate 1500, and therefore, even in the case where the inclination such as the warpage or the distortion generates in the bottom plate 301, it is possible to suppress that the front-side plate 302 is influenced by the inclination of the bottom plate 301.

Other Embodiments

In the above-described embodiments, the constitution in which the front-side plate 302 is adjusted in accordance with the inclination direction and the inclination angle of the rear-side plate 303 was described, but by employing the constitutions of the above-described embodiments, a constitution in which the rear-side plate 303 is adjusted in accordance with the inclination direction and the inclination angle of the front-side plate 302 may also be employed. In this case, the constitution may only be required that the front-side plate 302 is first fixed to the bottom plate 301 by using the jig 900 and the like.

Further, in the above-described embodiments, the free end portion shape of the projected portion 320*a* provided as the part of the front-side plate 302 was the substantially V-shape, but a constitution in which the projected portion 320*a* has a V-shape with an acute tip may also be employed when the projected portion 320*a* point-contacts the bottom portion 301*c* of the bottom plate 301. Further, the radius of curvature is not limited to the above-described radius of curvature when a constitution in which the projected portion 320*a* of the front-side surface portion 320 point-contacts the bottom portion 301*c* of the bottom plate 301 is employed. Even in this case, as described above, the projected portion 320*a* point-contacts the bottom portion 301*c* of the bottom plate 301 and thus the front-side plate 302 can swing relative to the bottom plate 301, so that the position of the front-side plate 302 relative to the rear-side plate 303 can be adjusted.

Further, in the above-described embodiments, the constitution in which in the state before the front-side plate 302 is fixed to the bottom plate 301, the gap M is formed between the bottom portion 301*c* and the lower end portion of the first bent and erected portion 321 with respect to the vertical direction is formed and the gap N is formed between the bottom portion 301*c* and the lower end portion of the second bent and erected portion 322 with respect to the vertical direction is formed was employed. In this constitution, in a state in which the front-side plate 302 and the bottom plate 301 are fixed to each other after the inclination direction and the inclination angle between the front-side plate 302 and the rear-side plate 303 are adjusted, the gaps M and N change. In design, when a constitution in which either one of the gaps M and N is 0 is employed, an adjustment range is narrowed, and therefore, in the state in which the front-side plate 302 and the bottom plate 301 are fixed to each other, it is desired that a constitution in which both the gaps M and N are not 0 is employed. However, when a constitution in which the front-side plate 302 is swingable relative to the bottom plate 301 and the adjustment of the front-side plate 302 relative to the rear-side plate 303 is sufficiently enabled is employed, a constitution in which either one of the gaps M and N is 0 in the state in which the front-side plate 302 and the bottom plate 301 are fixed to each other may also be employed.

Incidentally, in the above-described embodiments, the constitution in which the component parts of the supporting frame 300 are fixed by being fastened with the screws was employed, but another fixing method such as laser welding may also be employed. In this case, the gaps D and E provided between the front-side plate 302 and the bottom plate 301 are set at intervals in which the laser welding is enabled, so that the front-side plate 302 and the bottom plate 301 can be fixed to each other by the laser welding.

Incidentally, in the above-described embodiments, the constitution of the supporting frame 300 of the inspecting device 102 including the feeding roller pairs and the reading units such as the CIS units, as the inner units was described, but the constitutions of the above-described embodiments may also be applied to a supporting frame of another device or apparatus. For example, to a supporting frame of a sheet feeding device for feeding the sheet, such as a decurler device for rectifying a curl of the sheet, the constitution of the above-described supporting frame 300 may also be applied. Even in this case, it is possible to suppress that parallelism between the rotation shafts of the rotatable members becomes poor due to the difference in inclination direction and inclination angle between the front-side plate 302 and the rear-side plate 303 of the supporting frame 300. Accordingly, it is possible to suppress the oblique movement of the sheet fed by the feeding roller pair in the sheet feeding device.

According to the present invention, it is possible to provide the supporting frame of the sheet feeding device capable of improving accuracy of relative position between the pair of side plates.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2020-033881 filed on Feb. 28, 2020 and 2020-195549 filed on Nov. 25, 2020, which are hereby incorporated by reference herein in their entirety.

What is claimed is:

1. A supporting frame of a sheet feeding device for supporting a feeding unit including a feeding roller pair capable of nipping and feeding a sheet, comprising:

a bottom plate;

a first side plate fixed to said bottom plate and supporting one end side of the feeding unit with respect to a rotational axis direction of the feeding roller pair; and a second side plate fixed to said bottom plate with a predetermined interval from said first side plate and supporting the other end side of the feeding unit with respect to the rotational axis direction of the feeding roller pair, wherein said first side plate includes a supporting portion supporting said one end side of the feeding unit, a first bent and erected portion bent and erected substantially perpendicular to said supporting portion, and a second bent and erected portion provided on a side opposite from said first bent and erected portion with respect to a sheet feeding direction of the feeding unit and bent and erected substantially perpendicular to said supporting portion, wherein said supporting portion includes a swing center portion having a swing center of said first side plate when said first side plate is positionally adjusted relative to said second side plate, and wherein in a direction in which a bending edge line formed between said supporting portion and said first bent and erected portion extends, said swing center portion projects downward than a lower end portion of said first bent and erected portion and a lower end portion of said second bent and erected portion are and contacts said bottom plate.

2. A supporting frame according to claim 1, wherein said bottom plate includes a bottom portion where said swing center portion contacts said bottom plate, a first bending portion bent and erected substantially perpendicular to said bottom portion, and a second bending portion different from said first bending portion and bent and erected substantially perpendicular to said bottom portion, wherein said first bent and erected portion is fixed with said first bending portion, and wherein said second bent and erected portion is fixed with said second bending portion.

3. A supporting frame according to claim 2, wherein the lower end portion of said first bent and erected portion and the lower end portion of said second bent and erected portion are in non-contact with said bottom portion.

4. A supporting frame according to claim 1, wherein said bottom plate includes a bottom portion where said swing center portion contacts said bottom portion, and wherein said bottom plate further includes a fixing metal plate fixing said supporting portion of said first side plate to said bottom portion.

5. A supporting frame according to claim 4, wherein the lower end portion of said first bent and erected portion and the lower end portion of said second bent and erected portion are in non-contact with said bottom portion.

6. A supporting frame according to claim 1, wherein when said first side plate is viewed in a rotational axis direction of the feeding unit, said swing center portion has a substantially V-shape.

7. A supporting frame according to claim 1, wherein when said first side plate is viewed in a rotational axis direction of the feeding unit, said swing center portion includes an end portion which contacts said bottom portion and which has an arcuate shape.

8. A supporting frame according to claim 1, wherein said first side plate has a maximum length with respect to a vertical direction, which is not less than two times a maximum length thereof with respect to a horizontal direction.

9. A supporting frame according to claim 1, wherein said second side plate includes a second supporting portion extending in a vertical direction and supporting the other end side of the feeding unit, and a bottom fixing portion formed by being bent and erected substantially perpendicular to said second supporting portion and fixed to said bottom plate.

10. A supporting frame according to claim 1, wherein said bottom plate is provided with a caster on a surface thereof opposite from a surface where said swing center portion contacts said bottom plate.

11. A sheet feeding device comprising:

a supporting frame according to claim 1; and an outer casing cover covering said sheet feeding device supporting frame.

12. An image reading apparatus comprising:

a supporting frame according to claim 1; and a reading unit provided downstream of the feeding roller pair with respect to the sheet feeding direction of the feeding roller pair and configured to read image information of the sheet fed by the feeding roller pair, wherein said reading unit is supported by said first side plate on one end side with respect to a longitudinal direction and is supported by said second side plate on the other end side with respect to the longitudinal direction.

13. An image forming system comprising:

an image forming apparatus configured to form an image on a sheet;

an image reading apparatus according to claim 12, provided downstream of said image forming apparatus with respect to the sheet feeding direction and configured to read image information of the image formed by said image forming apparatus; and a discharging device provided downstream of said image reading apparatus with respect to the sheet feeding direction and configured to discharge the sheet passed through said image reading apparatus.

14. An image forming system according to claim 13, further comprising a discriminating portion configured to discriminate occurrence or non-occurrence of an abnormal image on the basis of the image information read by said image reading apparatus, wherein said discharging device includes a plurality of trays for stacking sheets and discharges the sheet on which the abnormal image is detected and the sheet on which the abnormal image is not detected, to different trays, respectively.

* * * * *